US008272812B2

(12) United States Patent
Woolbright

(10) Patent No.: US 8,272,812 B2
(45) Date of Patent: Sep. 25, 2012

(54) RETAINING WALL SYSTEM

(75) Inventor: Mark Woolbright, St. Louis, MO (US)

(73) Assignee: Smart Slope LLC, Baltimore, MD (US)

( * ) Notice: Subject to any disclaimer, the term of this patent is extended or adjusted under 35 U.S.C. 154(b) by 40 days.

(21) Appl. No.: 12/742,683

(22) PCT Filed: Aug. 17, 2009

(86) PCT No.: PCT/US2009/054045
§ 371 (c)(1),
(2), (4) Date: May 13, 2010

(87) PCT Pub. No.: WO2010/019949
PCT Pub. Date: Feb. 18, 2010

(65) Prior Publication Data

US 2010/0251649 A1 Oct. 7, 2010

Related U.S. Application Data

(60) Provisional application No. 61/089,063, filed on Aug. 15, 2008.

(51) Int. Cl.
*E04C 2/04* (2006.01)
*E02D 3/02* (2006.01)

(52) U.S. Cl. ..... 405/286; 52/561; 52/612; 405/284

(58) Field of Classification Search ..... 52/309.17, 52/596, 604, 605, 606, 561, 415, 612; 405/284, 405/286, 287, 287.1
See application file for complete search history.

(56) References Cited

U.S. PATENT DOCUMENTS

| | | | |
|---|---|---|---|
| 1,015,584 | A | 1/1912 | Powell |
| 1,349,552 | A | 8/1920 | Gaumann |
| 2,313,363 | A | 3/1943 | Scmitt |
| 3,073,061 | A | 1/1963 | Pearson |
| 3,389,499 | A | 6/1968 | Haile |
| D217,244 | S | 4/1970 | Fairfield |

(Continued)

FOREIGN PATENT DOCUMENTS

| | | |
|---|---|---|
| FR | 2651258 | 3/1991 |

(Continued)

OTHER PUBLICATIONS

Machine Translation of KR 20-0241923.*

(Continued)

*Primary Examiner* — Robert Canfield
*Assistant Examiner* — Brent W Herring
(74) *Attorney, Agent, or Firm* — Bryan Cave LLP

(57) ABSTRACT

Retaining wall building blocks for receiving fill material during construction of a retaining wall, retaining walls constructed with the building blocks and methods of manufacture of the building block wherein the block comprises a cast cement body having a base, a generally upright face wall extending upward from the base, two generally upright side walls extending upward from the base and generally rearward of the face wall, the base, upright face wall, and side walls each having an inner and an outer surface, the side walls each having a top and a rearward most end, and a fill receiving cavity defined by base inner surface, side wall inner surfaces and face wall inner surface for receiving fill material, the fill receiving cavity having a volume wherein a ratio of the volume of the fill receiving cavity to the volume of the retaining wall building block is at least 0.75:1, respectively.

22 Claims, 26 Drawing Sheets

U.S. PATENT DOCUMENTS 3,995,434 A 12/1976 Kato et al.
4,060,952 A 12/1977 Hernandez
4,107,894 A 8/1978 Mullins
4,128,981 A * 12/1978 Juba ..... 52/309.3
4,132,043 A * 1/1979 Juba ..... 52/309.17
4,229,123 A 10/1980 Heinzmann
4,379,659 A 4/1983 Steiner
4,384,810 A 5/1983 Neumann
4,426,176 A 1/1984 Terada
4,470,728 A 9/1984 Broadbent
4,476,657 A * 10/1984 Juba et al. ..... 52/139
4,521,138 A 6/1985 Steiner
4,565,043 A 1/1986 Mazzarese
4,658,541 A 4/1987 Haile
4,671,706 A * 6/1987 Giardini ..... 405/286
4,684,294 A 8/1987 O'Neill
D296,007 S 5/1988 Forsberg
D296,365 S 6/1988 Forsberg
4,804,294 A * 2/1989 Barthel ..... 405/30
4,804,299 A 2/1989 Forte et al.
D300,253 S 3/1989 Forsberg
D300,254 S 3/1989 Forsberg
4,824,293 A 4/1989 Brown et al.
4,914,876 A 4/1990 Forsberg
4,917,543 A 4/1990 Cole et al.
4,920,712 A 5/1990 Dean, Jr.
4,930,283 A 6/1990 Winkler
D310,267 S 8/1990 Zeidman
4,964,761 A 10/1990 Rossi
4,982,544 A 1/1991 Smith
5,003,746 A 4/1991 Wilston
5,017,049 A 5/1991 Sievert
D319,885 S 9/1991 Blomquist et al.
5,044,834 A 9/1991 Janopaul, Jr.
5,066,169 A * 11/1991 Gavin et al. ..... 405/284
5,072,566 A 12/1991 Zeidman
5,098,059 A * 3/1992 Sawyer ..... 249/16
5,108,231 A 4/1992 Rausch
5,140,728 A * 8/1992 Chandler et al. ..... 27/35
5,154,542 A * 10/1992 Klenert ..... 405/286
5,163,261 A 11/1992 O'Neill
5,177,925 A * 1/1993 Winkler et al. ..... 52/607
5,214,898 A 6/1993 Beretta
D340,996 S 11/1993 Woolbright
5,277,012 A 1/1994 Woolbright
D347,285 S 5/1994 Woolbright
5,337,527 A 8/1994 Wagenaar
D351,239 S 10/1994 Klenert
D357,748 S 4/1995 Jansson
5,419,092 A * 5/1995 Jaecklin ..... 52/562
5,425,600 A 6/1995 Gordon
D360,475 S 7/1995 Woolbright
D362,077 S 9/1995 Woolbright
5,484,234 A 1/1996 Worden
5,484,235 A 1/1996 Hilfiker et al.
5,499,891 A * 3/1996 Klenert ..... 405/284
D372,106 S 7/1996 Woolbright
5,540,525 A 7/1996 Miller et al.
5,564,865 A * 10/1996 Jansson ..... 405/286
5,601,384 A 2/1997 Dawson
5,658,098 A * 8/1997 Woolbright ..... 405/284
D387,434 S 12/1997 Dawson
5,740,637 A * 4/1998 Snow ..... 52/136
5,741,339 A 4/1998 DuMars et al.
D397,451 S 8/1998 Stevenson
5,913,790 A 6/1999 Dawson
5,921,715 A 7/1999 Rainey
6,036,405 A 3/2000 Nove et al.
6,287,054 B1 9/2001 Egan et al.
6,318,934 B1 11/2001 Borgersen et al.
6,371,700 B1 4/2002 Rich
6,692,195 B2 * 2/2004 Jansson ..... 405/286
6,761,509 B2 * 7/2004 Jansson ..... 405/286
6,808,339 B2 10/2004 Peterson et al.
6,884,004 B1 4/2005 Scales et al.
6,889,479 B2 * 5/2005 Thorpe ..... 52/596
D510,774 S 10/2005 Jansson
D514,232 S * 1/2006 Jansson ..... D25/118
7,083,364 B2 8/2006 Kim
D528,223 S * 9/2006 Jansson ..... D25/118
7,524,144 B2 * 4/2009 Gravier et al. ..... 405/262
7,850,402 B1 * 12/2010 Justiniano ..... 405/286
7,854,573 B2 * 12/2010 Knudson et al. ..... 405/284
7,926,228 B1 * 4/2011 Snow ..... 52/136
2003/0029114 A1 2/2003 MacDonald et al.
2003/0086764 A1 * 5/2003 Knudson et al. ..... 405/284
2005/0129468 A1 6/2005 Knudson et al.
2005/0254906 A1 11/2005 Dolan et al.
2005/0279046 A1 12/2005 Gravier et al.
2009/0162147 A1 * 6/2009 Klenert ..... 405/284

FOREIGN PATENT DOCUMENTS

KR 200241923 7/2001

OTHER PUBLICATIONS

International Search Report for PCT/US2009/054045 dated Apr. 1, 2010.
Terraforce web site, retried on Oct. 21, 2011 from http://www.terraforce.com.
Infraset web site, retried on Oct. 21, 2011 from http://www.infraset.co.za.
Keystone Retaining Wall Systems, compac unit, do-it-yourself instructions, Mar. 12, 2008.
Keystone Retaining Wall Systems, standard unit, do-it-yourself instructions, Mar. 12, 2008.
Stonewall Retaining Systems, instructions manual, Mar. 12, 2008.
Versa-lok Retaining Wall Systems, instructions and product manual, Mar. 12, 2008.
Windsor Stone, product description and do-it-yourself instruction manual, Mar. 12, 2008.
Windsor Stone, helpful hints brochure, Mar. 12, 2008.
Hercules Mfg, Inc., Block Specification Sheet, Retrieved from http://www.herculesmfg.com/products/6.jpg on Nov. 16, 2011.
Versa-lok Retaining Wall Systems, Versa-Green product specification page, Retrieved from http://www.versa-lok.com/products/plantable-wall-systems/versa-green on Nov. 16, 2011.

* cited by examiner

RETAINING WALL SYSTEM

This application claims priority from U.S. patent application Ser. No. 61/089063, filed Aug. 15, 2008, the entire contents of which are incorporated herein by reference.

FIELD OF THE INVENTION

The present invention relates to a retaining wall system comprised of units, sometimes referred to as building blocks or modules comprising a cementitious or polymeric composition, and more specifically, to a retaining wall system comprised of building blocks or modules having a planter compartment.

BACKGROUND OF THE INVENTION

Currently, a wide variety of building blocks or modules are available for construction of retaining walls to hold back or support earth or other fill material, each tailored to a particular use. Generally, a retaining wall may be constructed with building blocks made from natural sources such as timber, granite or stone, or with man-made materials such as concrete. Man-made materials typically cost less than most natural materials and are more versatile since they may be formed to desired shapes and configurations.

In recent years, the modules used for construction of retaining walls typically comprise concrete. Concrete has a relatively high density (e.g., 1950 kg/m3-2250 kg/$m^3$ (120-140 lbs/$ft^3$)). Because of this high density, even relatively small modules can be quite heavy. For example, a concrete block which is 40 cm (16 inches)×30.5 cm (12 inches)×20 cm (8 inches) may weigh 45 kg (100 lbs) or more.

When retaining walls are constructed from concrete modules, the building blocks are typically placed in a side-by-side relation in layers or courses, in which a block on a second course overlaps two blocks on the first course, thereby providing structural support and stability. Many blocks, such as those shown in U.S. Pat. Nos. 4,379,659, 4,671,706 and 5,072,566 have troughs in which fill (e.g., earth, sand or gravel) can be packed to increase the weight of the block and provide an additional stabilizing force which prevents the relative movement of the blocks. To provide additional support, the blocks may be constructed with pins which hold the courses secure relative the courses disposed beneath and above. Other methods for supporting the retaining wall employ a geo-grid mesh which may be placed between courses of or otherwise mechanically connected to blocks with the grid running into the earth or other fill material behind the wall.

Also, in forming the retaining wall, the blocks may be stacked such that they form a set back (the angle of the wall relative to a horizontal plane) of less than ninety-degrees as viewed from the side. Many blocks, such as those disclosed in U.S. Pat. No. 4,671,706, are limited in the degree of set back they are capable of attaining. Depending on the landscaping requirements, it may be necessary to build the wall with a wide range of set back angles, typically from forty-five to ninety degrees relative the horizontal plane.

The individual modules forming the retaining wall system are typically substantially rectangular in shape, comprising a front, two side walls, and a bottom forming a single compartment that is open on its top, and may be filled with gravel, soil, and/or vegetation. See, for example, U.S. Pat. Nos. 5,277,012, 5,658,098, D340,996, D347,285, D360,475, D362,077 and D372,106. Vegetation is sometimes planted to provide a natural appearance and/or to partially cover the wall. Often the units have a front face that has a greater height than the side walls.

SUMMARY OF THE INVENTION

Among the several aspects and features of the present invention may be noted the provision of an improved retaining wall building block which has the advantages of relatively light weight, a simplified and efficient casting and demold process, and the incorporation of features for attachment of lifting machinery, reinforcing structures, retention of fill material between adjacent blocks in a course, creating curved retaining walls, and anchoring structures without disadvantages of dry cast concrete. As is known in the art, because wet cast concrete is supported in a mold during the cure process, only the minimum amount of concrete to support the end structure need be used. By contrast, because dry cast concrete blocks are extruded and must be relatively dry, the block must be more robust to maintain its shape prior to curing, while still in the green or plastic state. Thus, wet cast concrete allows reduction in materials used, resulting in a thinner and lighter block. Its reduced weight requires less shipping and handling effort and expense.

Briefly, therefore, the present invention is directed to a retaining wall building block for receiving fill material during construction of a retaining wall. The block comprises a cast cement body having a base, a generally upright face wall extending upward from the base, two generally upright side walls extending upward from the base and generally rearward of the face wall, the base, face and side walls having inner and outer surfaces and a polymeric liner proximate to the cement body which lines the interior surfaces of the base, face and side walls of the block.

Another aspect of the invention is a retaining wall building block for receiving fill material during construction of a retaining wall. The block comprises a cast cement body having a base, a generally upright face wall extending upward from the base, two generally upright side walls extending upward from the base and generally rearward of the face wall, the base, upright face wall, and side walls each having an inner and an outer surface, the side walls each having a top and a rearward most end, and a fill receiving cavity defined by base inner surface, side wall inner surfaces and face wall inner surface for receiving fill material, the fill receiving cavity having a fill receiving volume wherein the ratio of the fill receiving cavity to the volume of the retaining wall building block is at least 0.75:1.

Another aspect of the invention is a retaining wall building block assembly for receiving fill material during construction of a retaining wall. The assembly comprises a molded body having a base, a generally upright face wall extending upward from the base, two generally upright side walls extending upward from the base and generally rearward of the face wall, the base, upright face wall, and side walls each having an inner and an outer surface, the side walls each having a top and a rearward most end, and (i) a support bracket extending from one of the side walls to the other side wall and removably inserted in a pair of channels in the side walls for supporting another retaining wall building block placed thereon, or (ii) at least one shield removably inserted in at least one groove in at least one of the side walls, the groove extending from the inner surface to the outer surface of the side wall(s), the shield comprising a baffle and a tongue wherein the tongue is inserted in and retained by the groove to position the baffle beyond the outer surface of the side wall and in an orientation that is generally parallel to the face wall.

Another aspect of the present invention is a method of forming a composite retaining wall building block having a base, a generally upright face wall extending upward from the base, two generally upright side walls extending upward from the base and generally rearward of the face wall, the base, upright face wall, and side walls each having an inner and an outer surface, the side walls each having a top and a rearward most end. The method comprises (i) introducing a fluid cementitious material into a mold having a cement receiving cavity, the mold comprising a base having surfaces dimensioned to form the exterior surfaces of the base, side walls and face wall and an insert having surfaces dimensioned to form the inner surfaces of at least a portion of the base, the face wall, and the side walls, the insert and the mold base being press fit together, (ii) allowing the cement to at least partially cure to form a cement body, and (iii) removing the cement body from the mold base to provide a composite retaining wall building block comprising a cement body and a liner adhered to at least a portion of the inner surfaces of the base, the face wall and the side walls wherein the liner comprises the mold insert.

A further aspect of the present invention is a method of forming a composite retaining wall building block having a base, a generally upright face wall extending upward from the base, two generally upright side walls extending upward from the base and generally rearward of the face wall, the base, upright face wall, and side walls each having an inner and an outer surface, the side walls each having a top and a rearward most end. The method comprises (i) introducing a fluid cementitious material into a mold having a cement receiving cavity, the mold having surfaces dimensioned to form the inner and exterior surfaces of the base, side walls and face wall, and (ii) allowing the cement to at least partially cure to form a cement body.

A further aspect of the present invention is a method for forming a retaining wall. The method comprises placing building block or building block assemblies of the present invention in side-by-side relation in at least two courses.

Generally, in one embodiment a retaining wall building block of the present invention comprises a base, a generally upright face wall extending upward from the base, and two generally upright side walls extending upward from the base and generally rearward of the face wall. A fill receiving cavity is defined by inner surfaces of the base, face wall, and side walls for receiving fill material such as earth during construction of a retaining wall. Because of the inherent efficiency in the wet cast concrete process, the base face wall, and side walls may each have a mean thickness which is less than approximately 20% of the width of the block to maximize the volume of the fill receiving cavity, the width of the block being defined by the distance between outer surfaces of the side walls.

The system of the present invention utilizes of injection molded forms, including an insert, preferably of polymer material, which mates with the mold base to form a complete mold to cast the concrete portion of the block. The formed wet concrete portion then becomes bonded to the insert to form a composite polymer/concrete block with the insert forming the interior cavity surface. The insert also preferably comprises pre-formed slots to receive a drop-in structural support which lends stability to the block for building curved walls. The slots also may receive a lifting bracket to facilitate connection with lifting machinery for handling and transporting blocks. The slots may mate with snap-in connectors to connect the block to geo-grid material which is secured in the soil behind the blocks to aid in placement of blocks on slopes. The insert may also include a connection hub for attaching to an anchoring grid.

Other objects and features will be in part apparent and in part pointed out hereinafter.

BRIEF DESCRIPTION OF THE DRAWINGS

Corresponding reference characters indicate corresponding parts throughout the several vies of the drawings.

Abbreviations and Definitions

Figure 1:
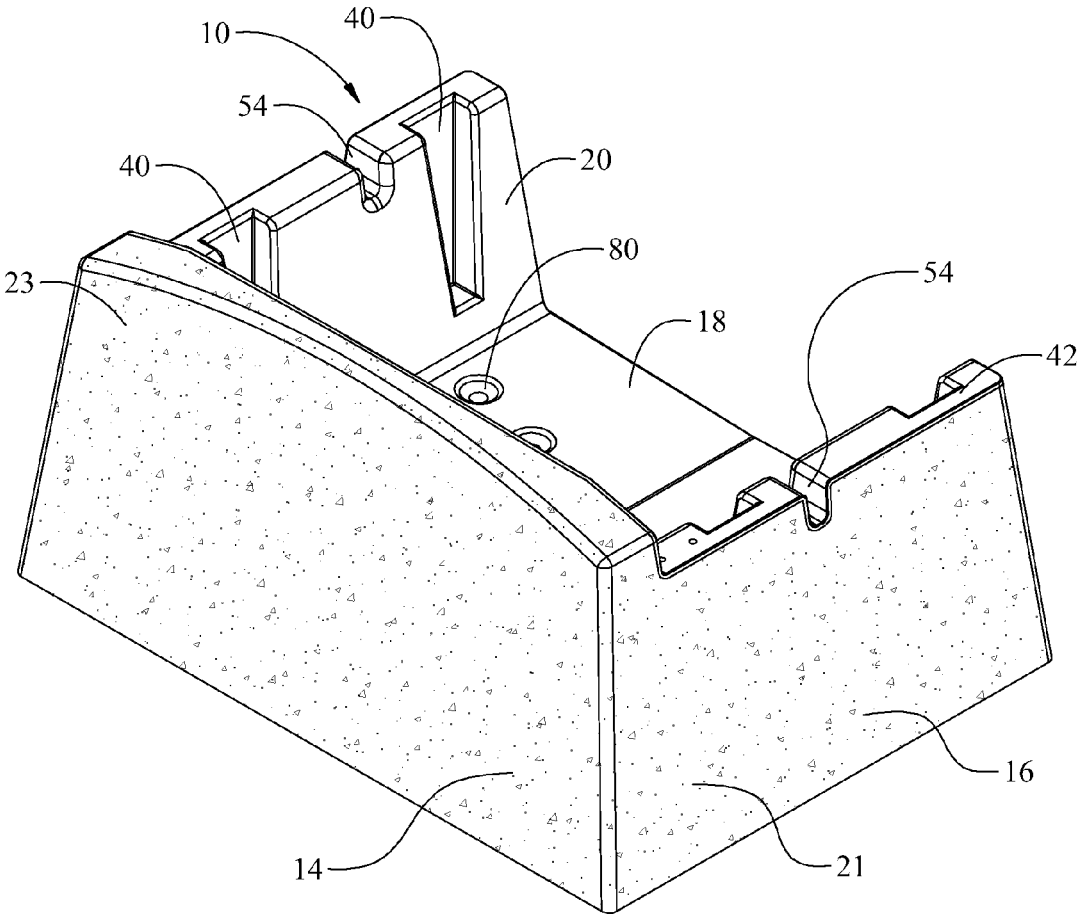
FIG. 1 is a front perspective view of a composite building block of the present invention.

The following definitions and methods are provided to better define the present invention and to guide those of ordinary skill in the art in the practice of the present invention. Unless otherwise noted, terms are to be understood according to conventional usage by those of ordinary skill in the relevant art.

The term "hydraulic cement" refers to any inorganic cement that hardens or sets due to hydration.

The term "non-hydraulic cement" refers to any inorganic cement that cannot harden while in contact with water, as opposed to hydraulic cement which can. Non-hydraulic cements may be created using materials such as non-hydraulic lime and gypsum plasters, and oxychloride.

DETAILED DESCRIPTION OF THE INVENTION

FIGS. 1-9 illustrate one preferred embodiment of the building block of the present invention, generally indicated in its entirety by the reference numeral 10. In general, building block 10 comprises base 12, generally upright face wall 14 extending upward from the base, and two generally upright side walls 16 extending upward from the base and generally rearward of the face wall. Base 12 has an inner surface 18 and an outer surface 19, sidewalls 16 have an inner surface 20 and an outer surface 21, and face wall 14 has an inner surface 22 and an outer surface 23. Fill receiving cavity 17 (FIGS. 2 & 4) is defined by base inner surface 18, side wall inner surfaces 20 and face wall inner surface 22 and receives fill material such as earth, sand, aggregate, mulch and the like during construction of a retaining wall.

As shown in FIGS. 1-9, building block 10 does not possess a rear wall but it is to be understood that it may optionally include a rear wall extending upward from the base, between upright side walls 16 (approximately parallel to face wall 14) and proximate rear edge 28 of base 12. If present, it is generally preferred that (i) at least a portion of the rear wall has a height which is less than the height of the side walls 16, (ii) the rear wall does not fully extend between the two side walls 16, or both.

In the embodiment illustrated in FIGS. 1-9, building block 10 is a composite, comprising a body 24 of a suitable cementitious material and a liner 26 of a non-cementitious material. Liner 26 is bonded to the body of cementitious material and lines, at least in part, fill receiving cavity 17. As depicted in FIGS. 1-9, the liner 26 is bonded to the face wall inner surface, the side wall inner surfaces, the base inner surface and the top 42 of the side walls. In other embodiments (not shown), the liner is bonded to (i) the face wall outer surface, (ii) the side wall outer surfaces or (iii) the face wall outer surface and the side wall outer surfaces. In yet another embodiment, building block is not a composite; that is, it is a body of a synthetic plastic or, alternatively, a body of cementitious material.

Depending upon the method of manufacture and materials of construction, side walls 16 may have a relatively constant or varying thickness as a function of distance from base 12. In one embodiment, the thickness of each of side walls 16 decreases as a function of increasing distance from base 12; stated differently, in this embodiment, the thickness $t^1$ of the side walls at the intersection 27 of the side wall inner surface and the base inner surface is greater than the thickness $t^2$ of the side walls at side wall tops 42, and the sum of $\alpha$ and $\beta$, in degrees, is greater than 180° (FIG. 4), wherein $\alpha$ is the angle defined by the base outer surface 19 and the side wall outer surface 21 and $\beta$ is the angle defined by the base outer surface and the side wall inner surface 20. Typically, $\alpha$ and $\beta$ will range from about 90° to about 100°. In one embodiment, $t^1$ is greater than $t^2$ and $\alpha$ and $\beta$ are each greater than 90°. In one preferred embodiment, $t^1$ is greater than $t^2$, $\alpha$ is 93°-97°, and $\beta$ is 93°-97°. In one embodiment, the ratio of $t^1$ to $t^2$ is less than 2:1, more preferably less than 1.75:1, and still more preferably less than 1.5:1. In an alternative embodiment, the thickness of each of the side walls 16 is relatively constant; stated differently, $t^1$ and $t^2$ are approximately equal and $\alpha$ and $\beta$ are each approximately 90°.

Although generally not preferred, the thickness or even the thickness variation of each of the two side walls 16 need not be the same; stated differently, one or more of $t^1$, $t^2$, $\alpha$ and $\beta$ may have a value for one of two side walls 16 that is different from its value for the other of the two side walls. Preferably, $t^1$ is approximately the same for each of the two side walls, $t^2$ is approximately the same for each of the two side walls, $\alpha$ is approximately the same for each of the two side walls, and $\beta$ is approximately the same for each of the two side walls.

Similarly, depending upon the method of manufacture, face wall 14 may have a relatively constant or varying thickness as a function of distance from base 12. In one embodiment, the thickness of face wall 14 decreases as a function of increasing distance from base 12; stated differently in this embodiment, the thickness $t^3$ of the face wall at the intersection 31 of the inner surface of the face wall and the inner surface of the base is greater than the thickness $t^4$ of the face wall at a position above side wall tops 42, and the sum of γ and δ, in degrees, is greater than 180° (FIG. 9) wherein γ is the angle between base outer surface 19 and face wall outer surface 23 and δ is the angle between base outer surface 19 and face wall inner surface 22. Typically, γ and δ will each range from about 90° to about 100°. In one embodiment, $t^3$ is greater than $t^4$ and γ and δ are each greater than 90°. In one preferred embodiment, $t^3$ is greater than $t^4$, γ is 93°-97°, and δ is 93°-97°. In one embodiment, the ratio of $t^3$ to $t^4$ is less than 2:1, more preferably less than 1.75:1, and still more preferably less than 1.5:1. In an alternative embodiment, the thickness of face wall 24 is relatively constant; stated differently, $t^3$ and $t^4$ are approximately equal and γ and δ are each approximately 90°.

Fill receiving cavity 17 has a fill receiving cavity volume that is bounded by the inner surfaces of the face wall, the two side walls, the base, and a rear wall, if present, or an imaginary rear wall (plane) extending upward from the rear edge of the base, having the same height as the side walls and approximately parallel to the inner surface of the face wall, if no rear wall is present. In its preferred embodiment, building block 10 has a fill receiving cavity volume that is approximately hexahedral in shape, with the two side faces of the hexahedron coinciding with the two side wall inner surfaces, one end face of the hexahedron coinciding with the face wall inner surface, the opposite end face of the hexahedron coinciding with the rear wall (if present) or an imaginary rear wall (plane) extending upward from the rear edge of the base, a bottom face of the hexahedron coinciding with the base inner surface and a top face of the hexahedron coinciding with an imaginary plane at the height of the side wall tops and approximately parallel to the base inner surface.

Figure 2:
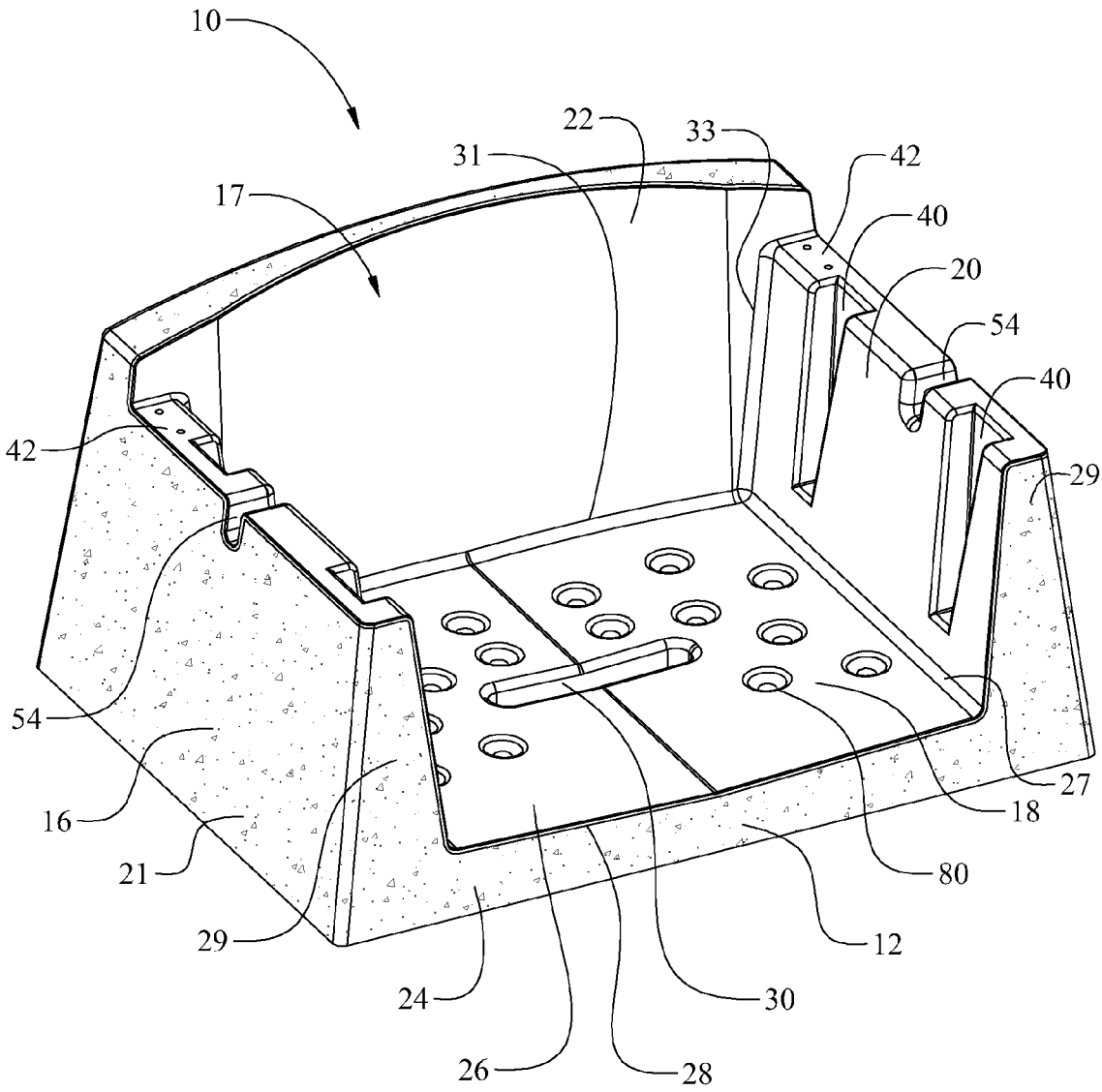
FIG. 2 is a rear perspective view of the building block of FIG. 1.
Figure 3:
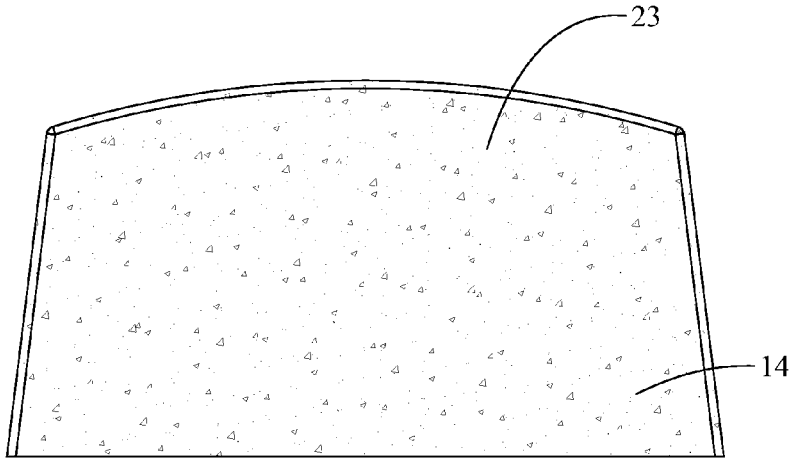
FIG. 3 is a front elevation view of the building block of FIG. 1.
Figure 4:
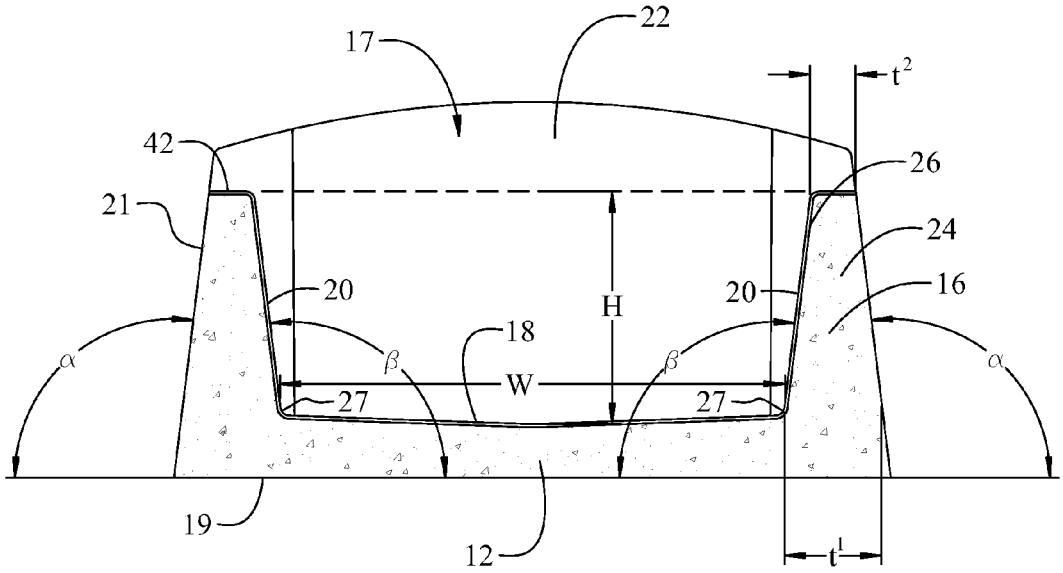
FIG. 4 is a rear elevation view of the building block of FIG. 1.
Figure 5:
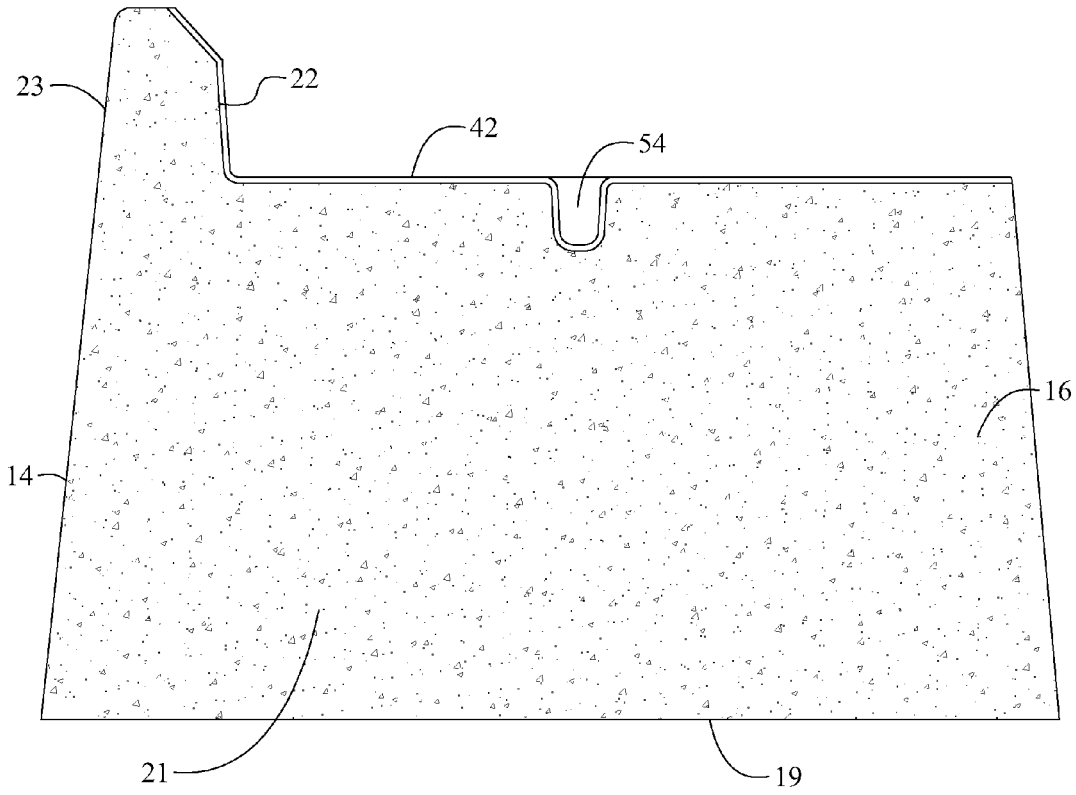
FIG. 5 is a side elevation view of the left side of the building block of FIG. 1.
Figure 6:
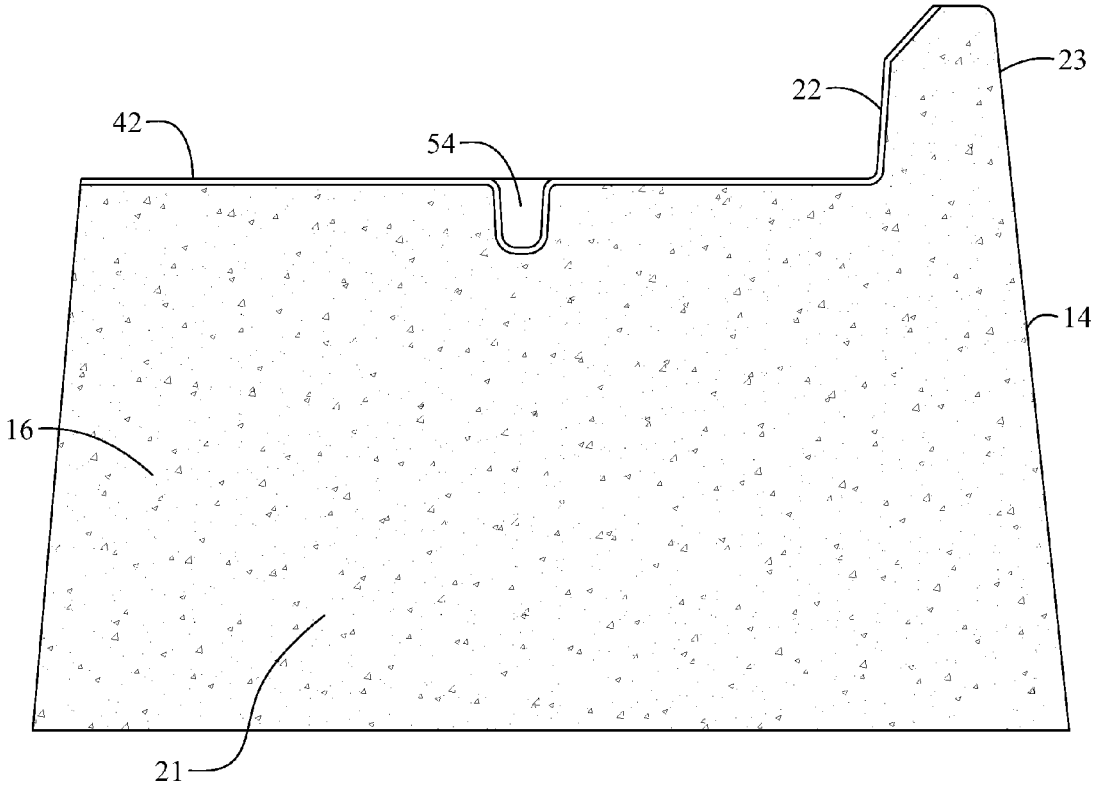
FIG. 6 is a side elevation view of the right side of the building block of FIG. 1.
Figure 7:
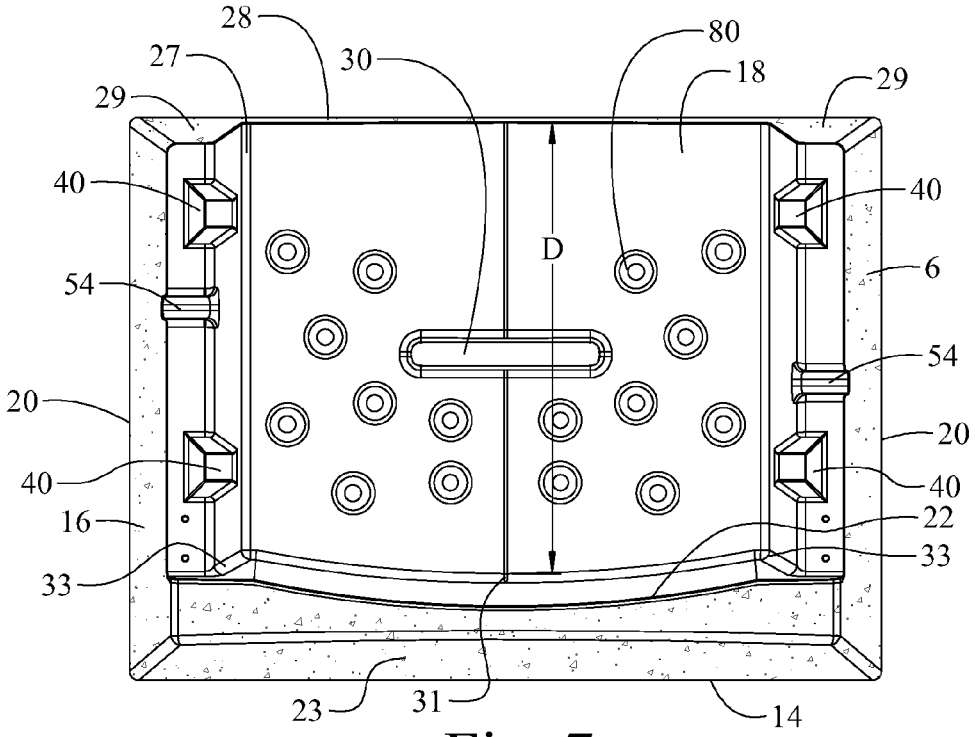
FIG. 7 is a top plan view of the building block of FIG. 1.
Figure 8:
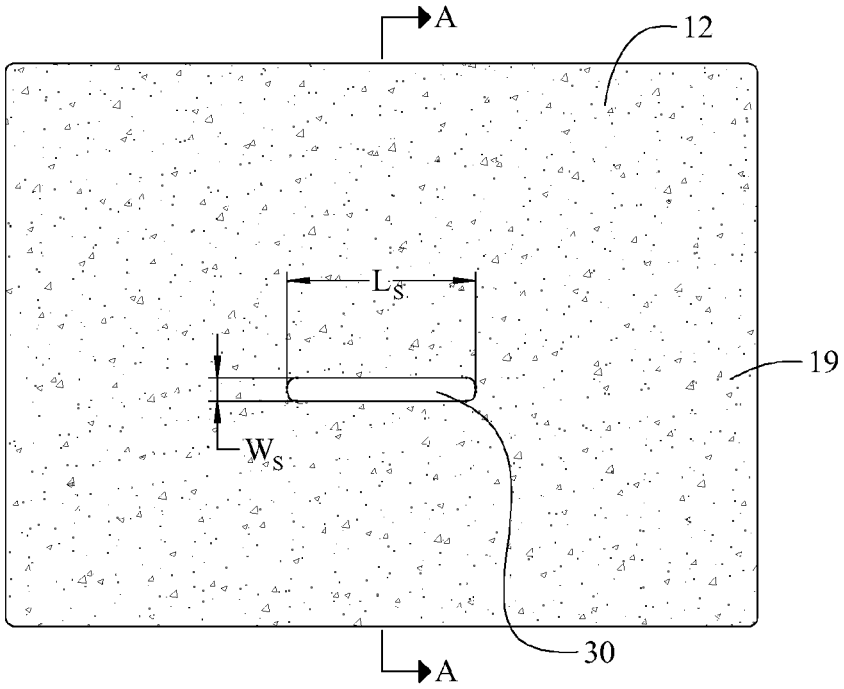
FIG. 8 is bottom plan view of the building block of FIG. 1.
Figure 9:
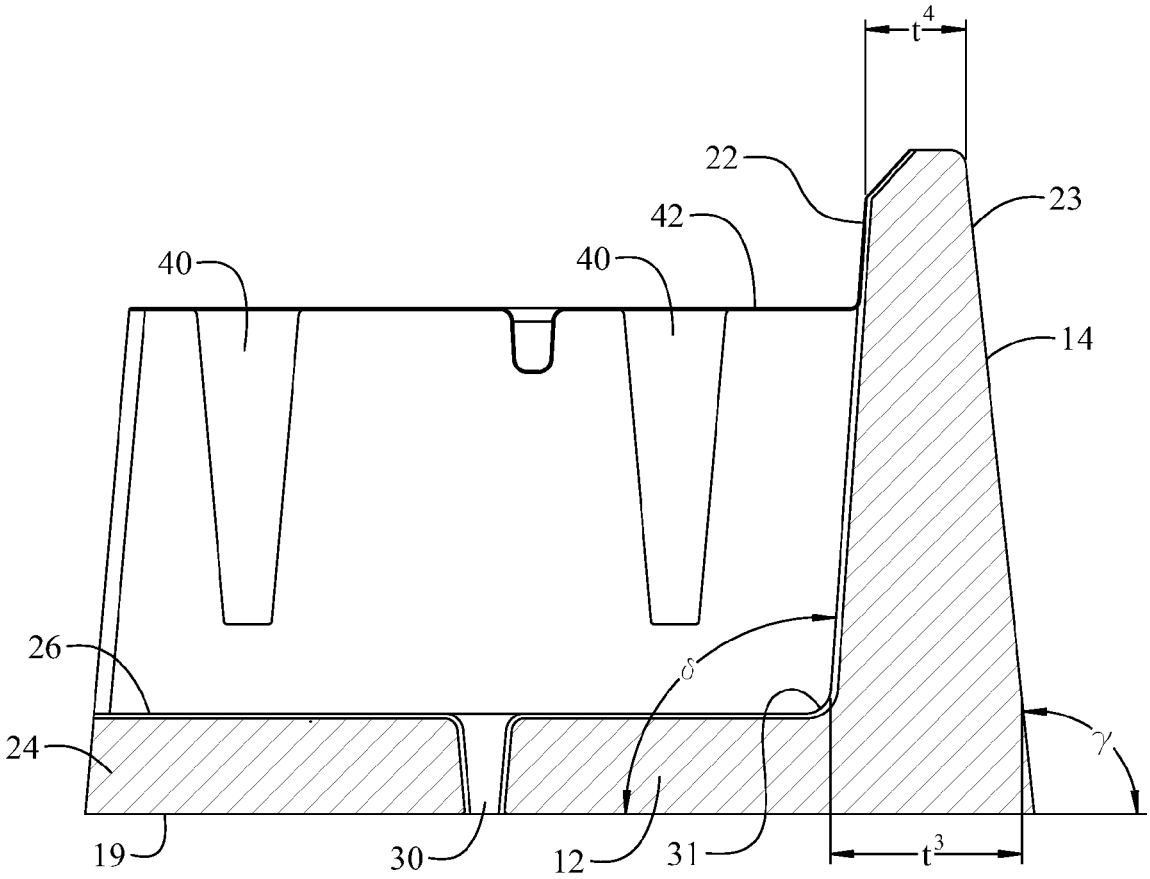
FIG. 9 is cross-sectional view of the building block of FIG. 1, taken along the plane of line A-A of FIG. 8.

The fill receiving volume of building block 10 (as illustrated in FIGS. 1-9) may be determined mathematically or by other means (e.g., measuring the quantity of water held by the bounded space). In other embodiments, however, the inner surfaces of the face wall, side walls, and base, and the rear edge of the base of building block 10 may be sufficiently curved or otherwise irregularly shaped that the actual fill receiving volume may be more difficult to determine. For example, the face wall inner surface 22 may be curved (e.g., the face wall thickness may vary as a function of distance from the intersections 33 of the face wall and each of the side walls), rear edge 28 may be curved (e.g., the distance from the intersection 31 of the face wall inner surface and the base inner surface may vary as a function of distance from the side walls). In such instances, resort may be had to a minimum fill receiving cavity volume that is the volume occupied by an imaginary cuboid (a hexahedron having three pairs of rectangles as its six faces) having a width W, a depth D, and a height H as further defined. The imaginary cuboid has a width W (FIG. 4) characterized by the shortest distance between (i) the intersection 27 of the inner surface of one of the two side walls and the base inner surface 18 and (ii) the intersection 27 of the inner surface of the other side wall and the base inner surface 18. The imaginary cuboid has a side wall height H (FIG. 4) characterized by the distance between (i) the intersection 31 (FIGS. 2 & 7) of the base inner surface 18 and the face wall inner surface and (ii) side wall tops 42. The imaginary cuboid has a depth D (FIG. 7) characterized by the shortest distance between (i) the intersection 31 of face wall inner surface 22 and the base inner surface 18 and (ii) the rear edge 28 of the base (FIGS. 2 & 7). Using the values for W, H and D, the imaginary cuboid has a volume is equal to the multiplication product of W, H and D (that is, the imaginary cuboid volume=W×H×D).

As a module in a retaining wall, building block 10 may actually support a quantity of fill material greater than the fill receiving cavity volume as defined above (i.e., the actual fill receiving cavity volume as determined mathematically or by other means, or the imaginary cuboid volume). For example, in addition to holding fill material in the fill receiving cavity 17, the building block supports a column of fill (not shown) extending upward above the fill receiving cavity and between blocks of a next higher course of blocks (see FIGS. 19, 20 and 25). However, because the volume of fill material may vary from one retaining wall to another, the fill volume has been defined solely on block characteristics to simplify the explanation.

In general, it is preferred that side wall tops 42 for each of the two sidewalls be relatively flat as a function of distance from face wall 14 to rearward most ends of side walls 29 and as a function of distance from side wall inner surface 20 to side wall outer surface 21. In a preferred embodiment, the liner which partially or entirely covers side wall tops provides a uniformly flat surface from side wall inner surface to side wall outer surface and from the face wall to the rearward most ends of the side walls. For example, in a preferred embodiment the side wall height as measured from the intersection 31 of the side wall inner surface to the base inner surface varies as a function of distance from the face wall to the rearward end for each of the side walls by no more than 1.25% from the mean height for each of the walls, preferably by no more than 1% of the mean height.

Figure 21:
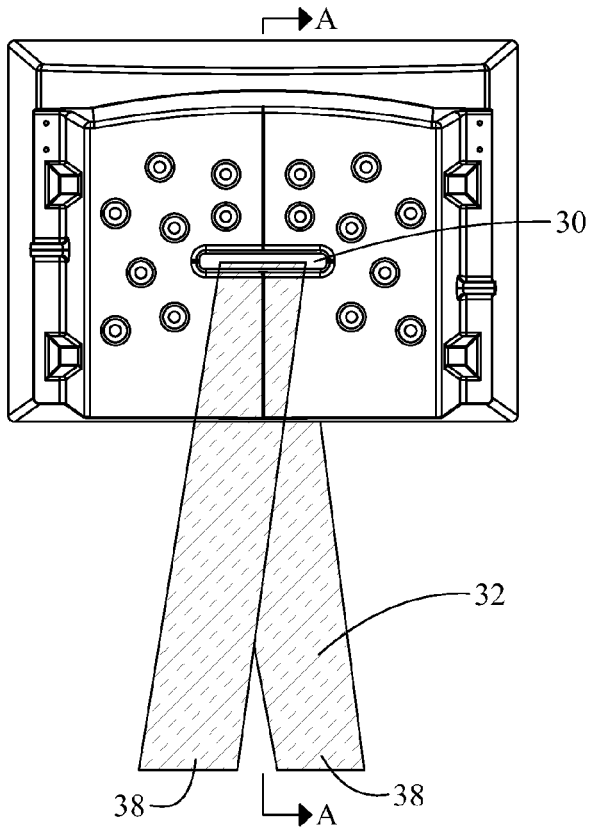
FIG. 21 is a top plan view of the building block of FIG. 1 with a strip of reinforcing material inserted through an elongate slot in the base of the building block.
Figure 22:
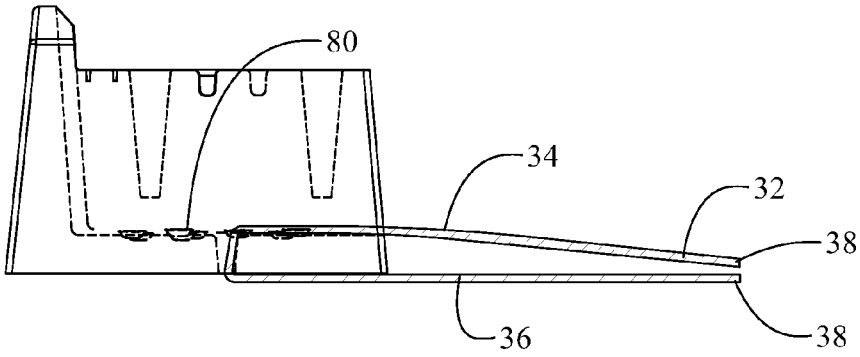
FIG. 22 is a cross-section of the building block of FIG. 1 with a strip of reinforcing material inserted through an elongate slot in the base of the building block taken along the plane of line A-A in FIG. 21.
Figure 23:
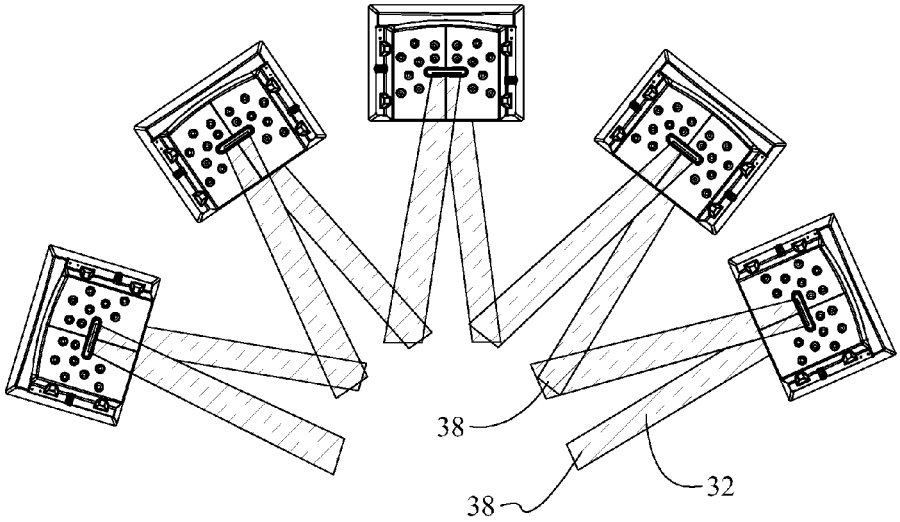
FIG. 23 is a top plan view of a retaining wall having a convex shape constructed of building blocks of FIG. 1 with a strip of reinforcing material inserted through an elongate slot in the base but with fill material omitted to show detail.
Figure 24:
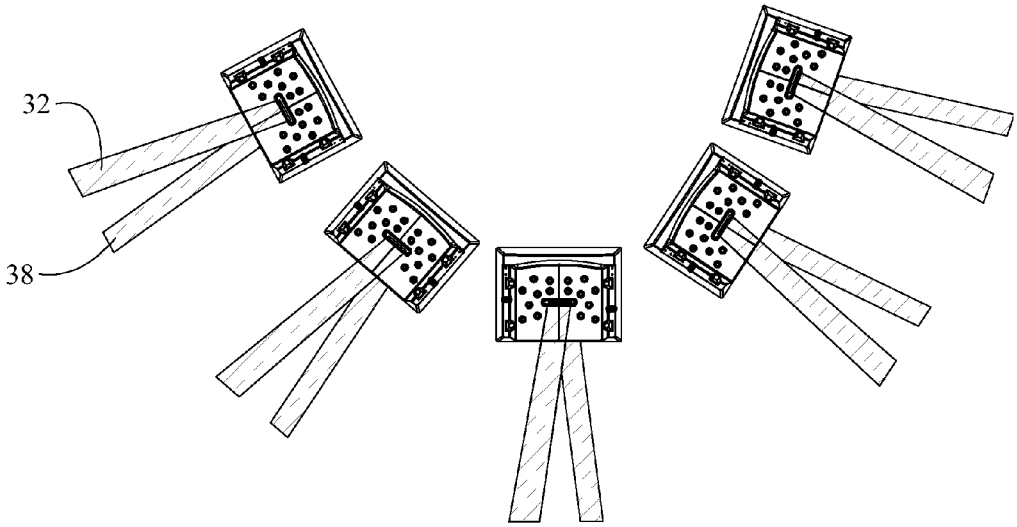
FIG. 24 is a top plan view of a retaining wall having a concave shape constructed of building blocks of FIG. 1 with a strip of reinforcing material inserted through an elongate slot in the base but with fill material omitted to show detail.
Figure 25:
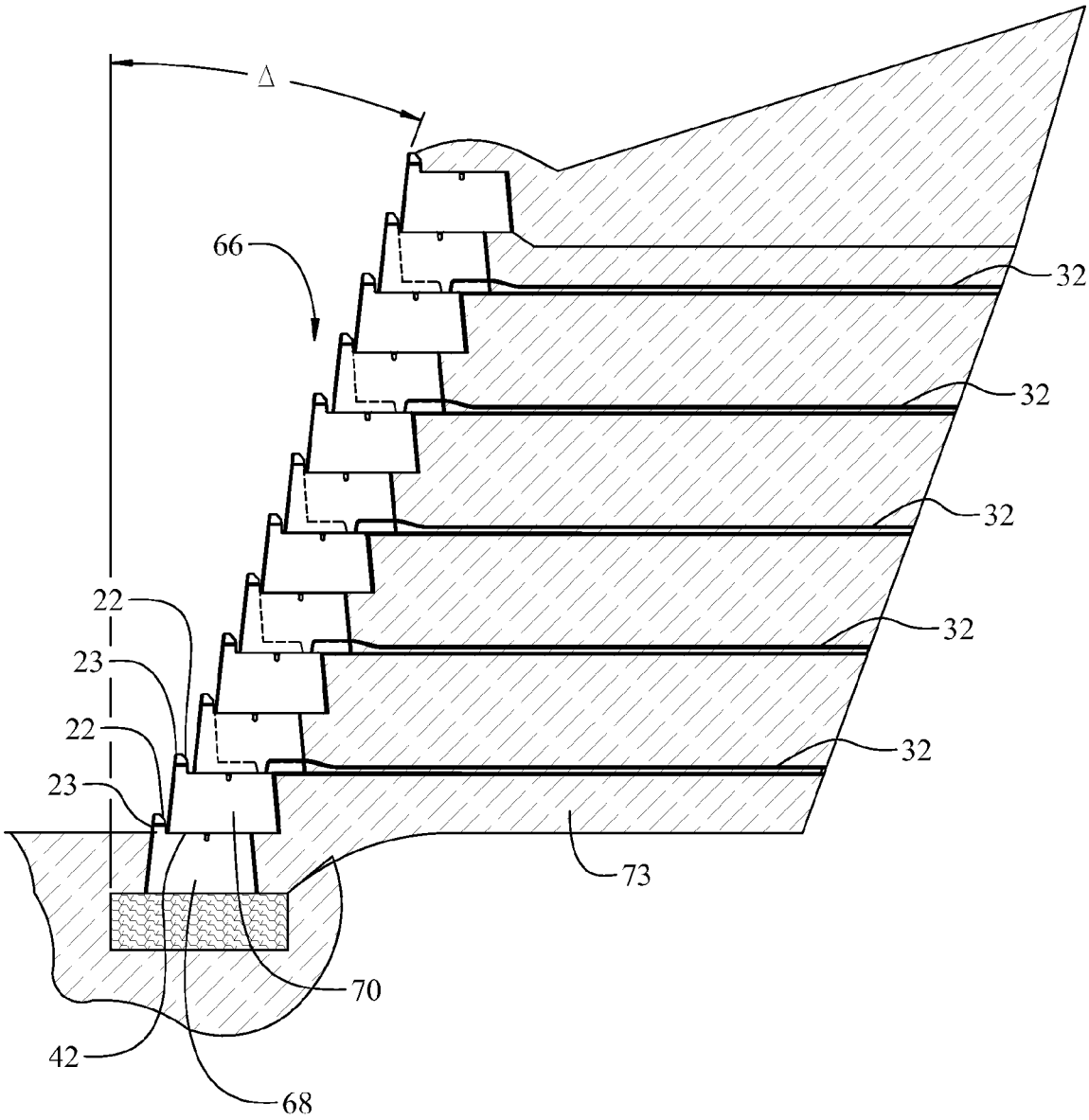
FIG. 25 is a side elevation view of a retaining wall constructed with the building blocks of FIG. 1 with strips of a reinforcing material inserted through an elongate slot in the base of building blocks and extending into the mass of earth or other fill material behind the retaining wall.

In a preferred embodiment, building block 10 has an elongate slot 30 extending through the entire thickness of base 12. Advantageously, a strip of reinforcing material 32 may be laced through slot 30 (FIGS. 21 & 22) with a top portion 34 of strip reinforcing material 32 residing above base inner surface 18 and a bottom portion 36 of the strip reinforcing material residing below base outer surface 19 and the two ends 38 of the strip being buried in earth or other material behind the block to anchor it (FIGS. 23-25). Any strip reinforcing material having sufficient tensile strength may be employed including, for example, Paraweb® retaining wall reinforcing material or any of a range of alternative reinforcing products commercially available from Tensar or TC Mirafi.

In general, elongate slot 30 is located in base 12 at a distance, as measured from rear edge 28 and in the direction of face wall inner surface 22, that is at least 10% of the value of D. More preferably, elongate slot is located in base 12 at a distance, as measured from rear edge 28 and in the direction of face wall inner surface 22, that is at least 20% of the value of D. Still more preferably, elongate slot is located in base 12 at a distance, as measured from rear edge 28 and in the direction of face wall inner surface 22, that is at least 30% of the value of D. Yet more preferably, elongate slot is located in base 12 at a distance, as measured from rear edge 28 and in the direction of face wall inner surface 22, that is at least 40% of the value of D. In addition, elongate is also preferably located in base 22 at a position that is approximately equidistant from each of side walls 16. To facilitate use of strip materials while maximizing contact area between base 12 and underlying earthen material in a retaining wall setting, elongate slot 30 preferably has a length $L_S$ (as measured in a direction parallel to the face wall and perpendicular to the side walls) and a width $W_S$ (as measured in a direction perpendicular to the face wall and parallel to the side walls) (FIG. 8) with the ratio of $L_S$ to $W_S$ being at least 2:1. In one preferred embodiment, the ratio of $L_S$ to $W_S$ is at least 5:1. In one preferred embodiment, the ratio of $L_S$ to $W_S$ is at least 10:1. In another embodiment, the ratio of $L_S$ to $W_S$ is at least 20:1. In yet another preferred embodiment, the ratio of $L_S$ to $W_S$ is about 5:1 to about 10:1, the elongate slot is located in base 12 at a distance, as measured from rear edge 28 and in the direction of face wall inner surface 22, that is between about 25% and about 75% of the value of D. When building block 10 is a composite of at least two disparate materials, elongate slot 30 may be pre-formed in liner 26.

Figure 40:
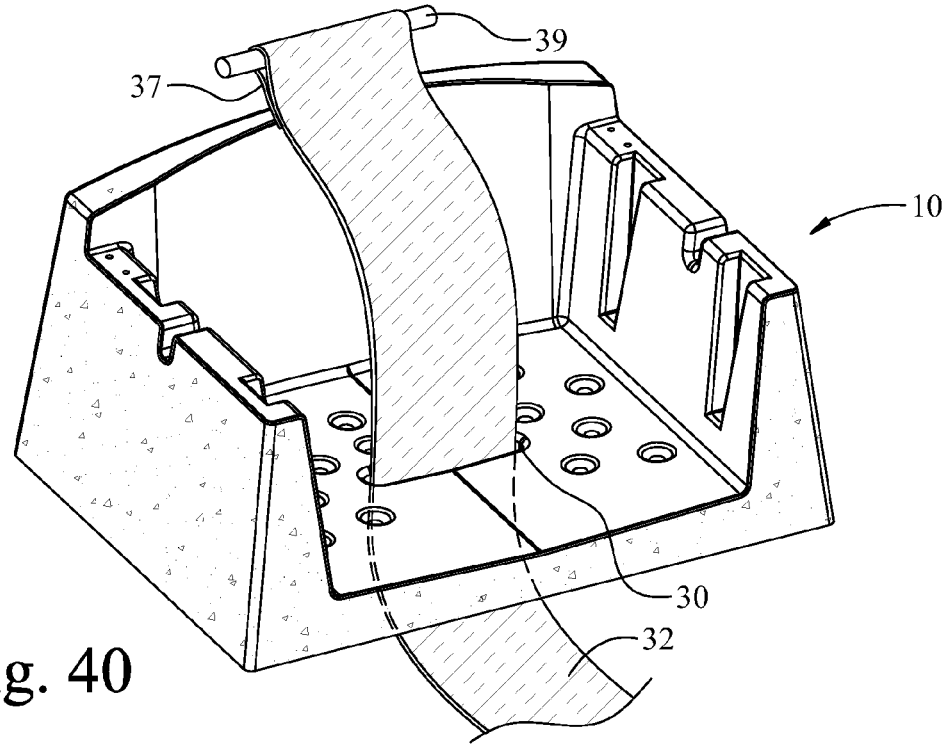
FIG. 40 is a rear perspective view of an assembly of the building block of FIG. 1 and an alternative strip reinforcing material partially laced through the elongate slot.
Figure 41:
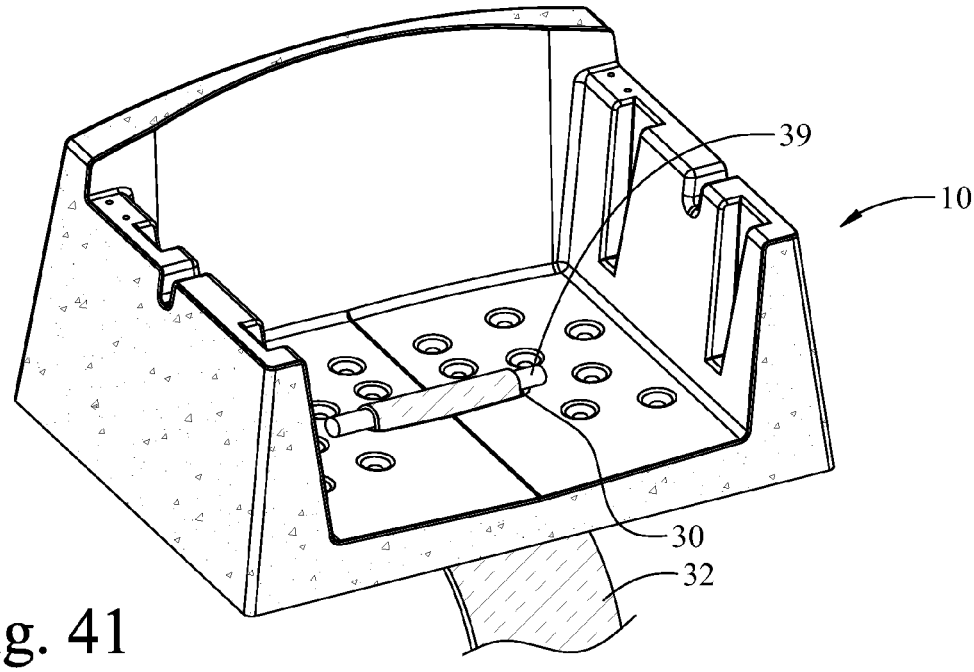
FIG. 41 is a rear perspective view of the assembly of FIG. 40 with the strip reinforcing material fully laced through and retained by the elongate slot.

Referring now to FIGS. 40 & 41, instead of burying the two ends of a strip of reinforcing material behind the building block 10, a strip of reinforcing material with a loop 37 at one end may be used. A post 39 that is larger than elongate slot 30 is inserted through the loop, and the strip of material is pulled through the slot such that the post rests upon the base inner surface and stops further movement of the strip through the slot. The other end of the strip 32 (not shown) is then buried in the earth or other fill material behind the building block to anchor it.

In an alternative embodiment, building block 10 may comprise a structure other than an elongate slot to facilitate anchoring. For example, base 12 may comprise openings having any of a range of geometric shapes, such as circular, triangular, rectangular that extend through the entire thickness of the base and through which anchoring materials such as steel or synthetic strip, mesh, cable, woven geosynthetics or geo-grid may be passed to help secure the building block. In other embodiments, a hub or other attachment structure may project upward from the base inner surface for connection to a geo-grid or other retention mechanism extending rearward from the rear edge 56 of the base and buried in the earth or other fill material behind the retaining wall. Alternatively, a snap-in connector may be installed in elongate slot 30 or other the slots once the block is in its final assembled position in the wall. For example, in one alternative embodiment, a series of loops may be attached to the elongate slot 30, a connection hub or other connection device possessed by the block 10 and buried in the fill material and behind the block with a pin inserted through the loops to make a bodkin type connection which may be used to secure a length of commercially available soil reinforcing material commonly known as geo-grid. In yet other embodiments, helical anchors, duckbill anchors, and various tail-like structures may be affixed to the building block to anchor it to the earth or other fill material behind the retaining wall.

In one embodiment, side wall inner surfaces 20 contain one or more sets of channels 40 (FIGS. 1, 2 & 7) that extend from the top of side walls 16 in the direction of base 12. When present, channels 40 are tapered with the channel becoming more narrow as a function of increasing distance from side wall tops 42 in the direction of base 22. Preferably, channels 40 have a length of at least 10% of the value of H; more preferably, channels 40 have length of at least 25% of the value of H. Typically, channels 40 have a length of at least 50% of the value of H; more preferably, channels 40 have length of about 50% to about 90% of the value of H.

Figure 30:
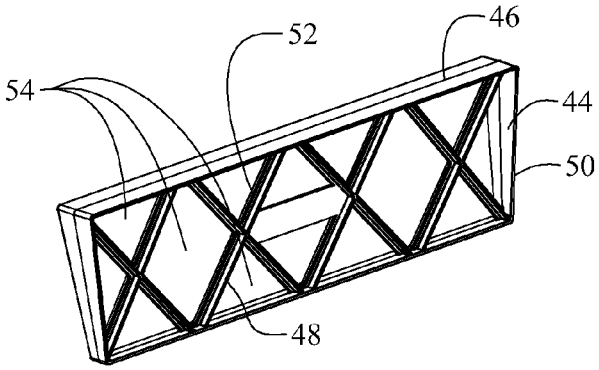
FIG. 30 is front perspective view of a support bracket of the present invention.
Figure 31:
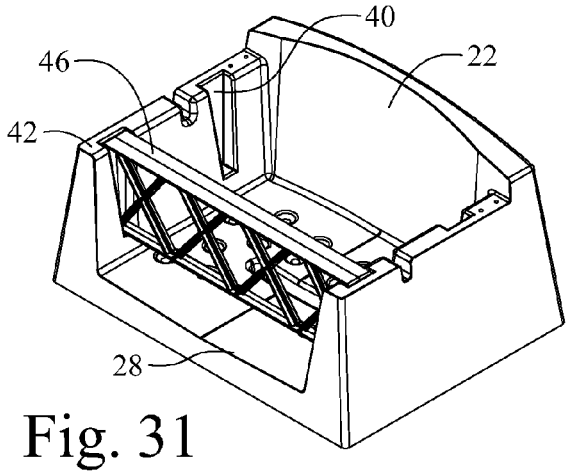
FIG. 31 is a rear perspective view of an assembly of a building block of FIG. 1 and a support bracket of FIG. 30.
Figure 32:
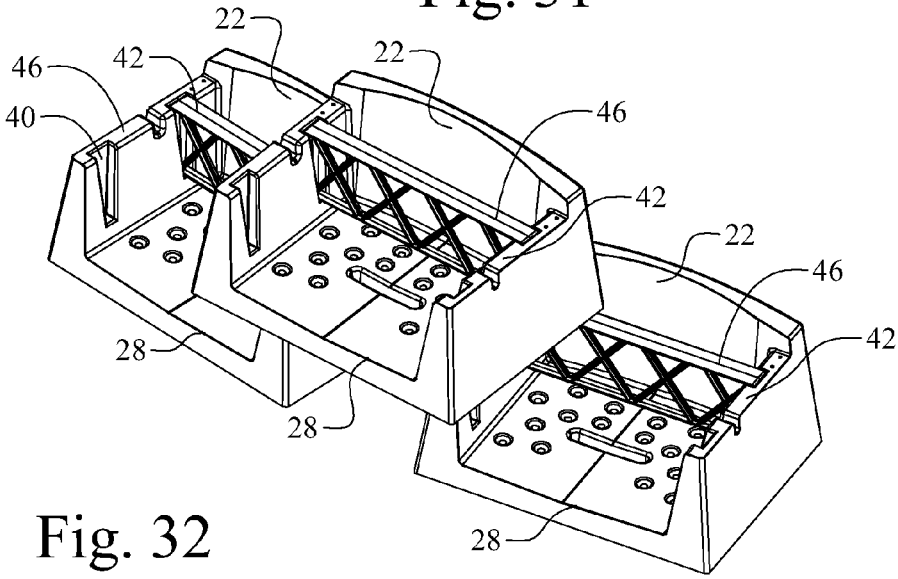
FIG. 32 is a rear perspective view of a concave retaining wall constructed with an assembly of the building blocks of FIG. 1 and the support bracket of FIG. 30 but with fill material omitted to show detail.

Referring now to FIGS. 30-32, support bracket 44 has a complementary size and taper to enable support bracket to be inserted into a set of channels 40. When fully inserted, bracket top surface 46 is level with side wall tops 42, thereby providing an additional support surface for an upper course of building blocks when a retaining wall is constructed. In general, support brackets inserted into channels positioned relatively closer to the face wall (FIG. 32) provide support in areas where the retaining wall has a concave contour (FIG. 24) whereas support brackets inserted into channels positioned relatively closer to rear edge 28 (FIG. 31) provide support in areas where the retaining wall has a convex contour (FIG. 23). In one embodiment, building block 10 includes a single set of channels to receive a support bracket. In another embodiment, building block 10 comprises two sets of channels to receive one or two support brackets. If building block 10 includes a single set of channels, one of the members of the set is located in one of side walls 16 and the other member of the set is located in the other of side walls 16 with the two being equidistant from rear edge 28 and at a distance, as measured from rear edge 28 and in the direction of face wall inner surface 22, that is between 25% and 75% of the value of D, typically between 40% and 60% of the value of D. If building block 10 includes two sets of channels, a first set is located in side walls 16 (one member in the first set being in one side wall 16 and the other member of the first set being in the other side wall) at a distance, as measured from rear edge 28 and in the direction of face wall inner surface 22, that is between 15% and 35% of the value of D, and the second set is located in side walls 16 (one member in the second set being in one side wall 16 and the other member of the second set being in the other side wall) at a distance, as measured from rear edge 28 and in the direction of face wall inner surface that is between 65% and 85% of the value of D. When building block 10 is a composite of at least two different materials, channels 40 may be pre-formed in liner 26.

Referring again to FIG. 30, support bracket 44 may be constructed from a wide range of materials and have a range of shapes. In a preferred embodiment, support bracket 44 comprises injection moldable plastic such as polypropylene, polyethylene, or polycarbonate. In addition, support bracket 44 preferably comprises a frame having top 46, bottom 48, side walls 50, reinforcing members 52, and openings 54. Openings 54 provide means for roots to infiltrate and integrate the support bracket into the retained mass behind the building block and to allow water and nutrients to flow freely from the front to the back of the building block (thereby avoiding any buildup of hydrostatic pressure). Openings 54 preferably occupy at least 25%, more preferably at least 50%, and still more preferably at least 75% of the area within support bracket frame.

Figure 26:
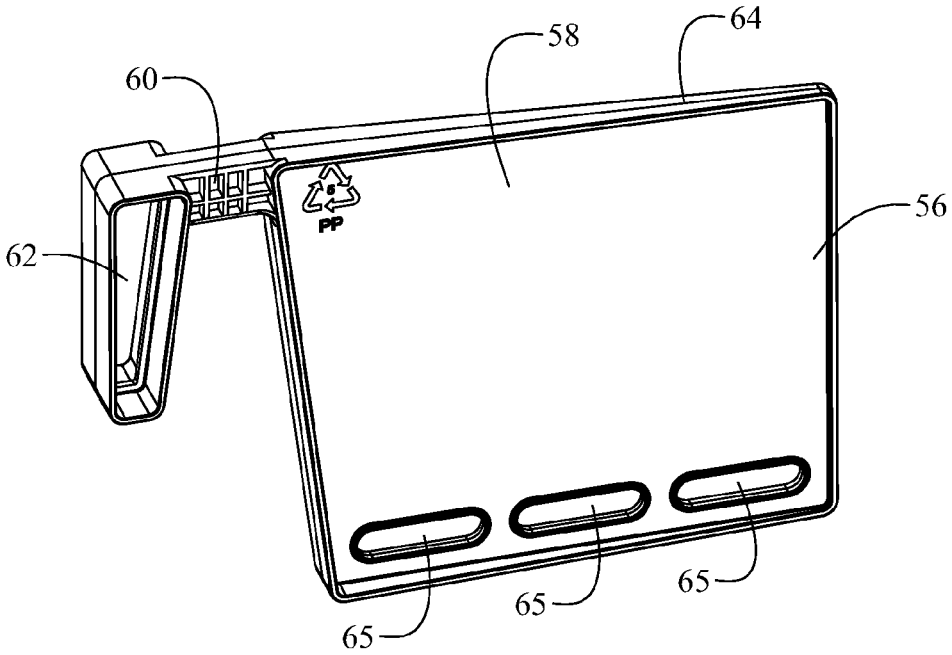
FIG. 26 is front perspective view of a baffle of the present invention.
Figure 27:
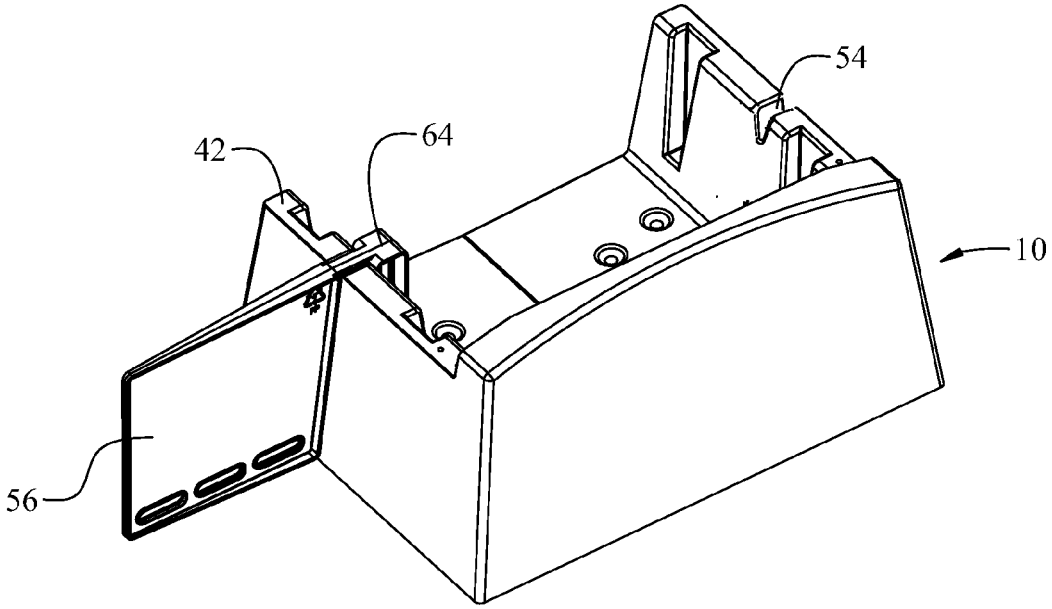
FIG. 27 is a front perspective view of the assembly of a building block of FIG. 1 and a baffle of FIG. 26.
Figure 28:
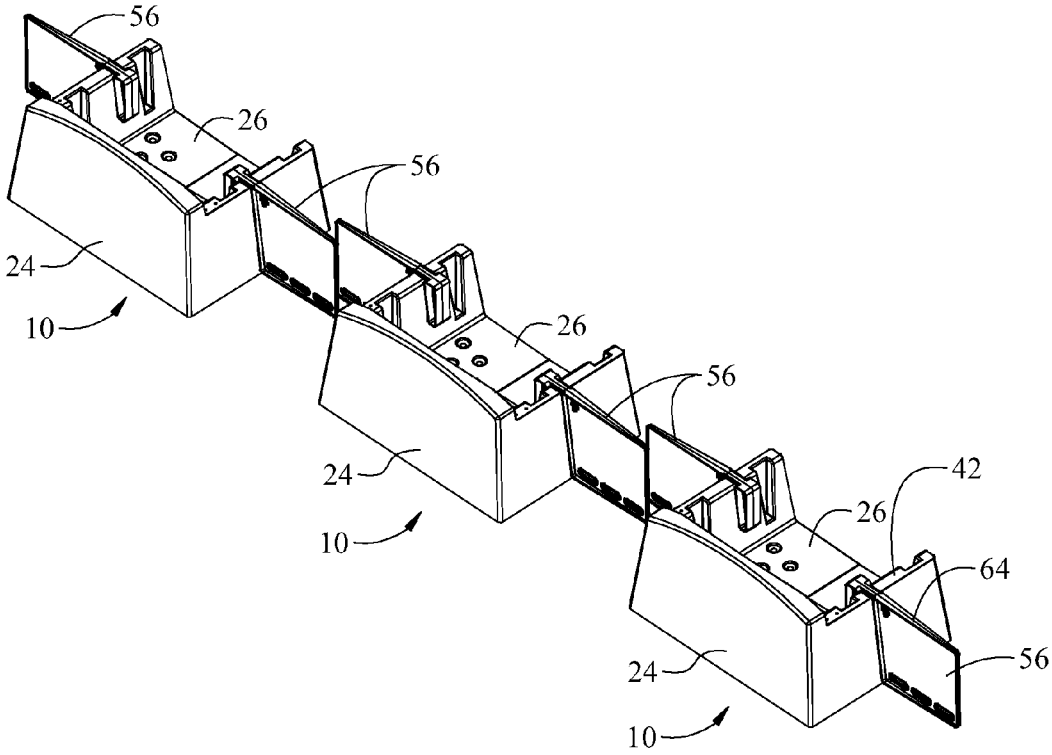
FIG. 28 is a front perspective view of a retaining wall constructed with an assembly of the building blocks of FIG. 1 and the baffles of FIG. 26 but with fill material omitted to show detail.
Figure 29:
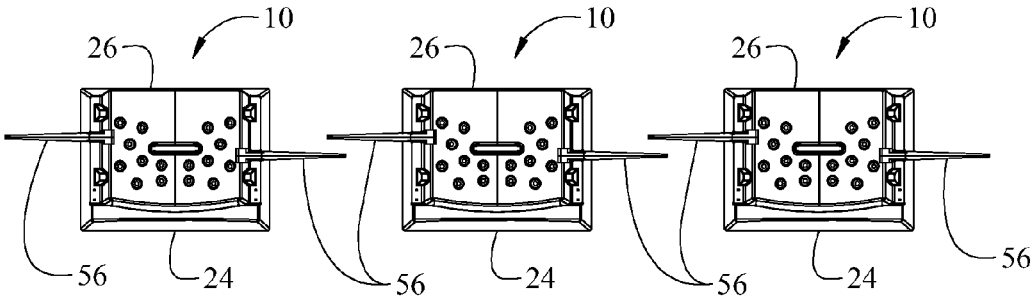
FIG. 29 is a top plan view of the retaining wall of FIG. 28.

In one embodiment, building block 10 contains one or more grooves 54 (FIGS. 1, 2, 5, 6 and 27) extending from the top of at least one of the side wall in the direction of base 22. In a preferred embodiment, building block 10 contains two grooves 54, one in each of side walls 16, extending from side wall tops 42 in the direction of base 12. Preferably, grooves 54 have a length, as measured from side wall tops 42 in the direction of base 12 of about 5% to about 15% of the value of H and a width (as measured in a direction parallel to the side wall) of about 1 to about 3 cm, preferably about 1 to about 2 cm. Grooves 54 are adapted to receive shields 56 (FIG. 26) which have a baffle 58, tongue 60, handle 62 and openings 65. Tongue 60 is inserted into groove 54 to position baffle 56 between adjacent blocks in a course of blocks (FIGS. 27, 28 & 29). When the tongue is fully inserted into the groove, shield top surface 64 will be level with or below side wall tops 42 to avoid providing a raised surface that may interfere with an upper course of building blocks when a retaining wall is constructed. Openings 65 provide means for roots to infiltrate and integrate the baffle into the retained mass behind the building block and to allow water and nutrients to flow freely from the front to the back of the building block (thereby avoiding any buildup of hydrostatic pressure). In one embodiment, building block 10 includes a single groove in one of side walls 16. In another embodiment, building block 10 comprises a groove in each of the side walls (FIGS. 28 & 29) with the two grooves being offset relative to the back of the block; stated differently, the distance between the groove in one of the two side walls and rear edge 28 is greater than the distance between the groove in the other side wall from rear edge 28 (FIG. 29). A pair of offset grooves advantageously enable two baffles to be positioned between adjacent blocks for added backfill retention. When building block 10 is a composite of at least two disparate materials, grooves 54 may be pre-formed in liner 26.

Referring now to FIG. 25, a retaining wall 66 is constructed by placing a first course with the side wall tops 42 of each of the blocks in the first course at the same elevation. If used, strip reinforcing material 32 is passed through the elongate slot or other opening in the base of a building block and the two ends of the strip are extended to an even distance into the backfill at the required design distance. Earth, stone, blended growth media or other fill material 73 may be used as backfill. A second course 70 is then placed on top of the first course, but each block in the second course is placed on side wall tops 42 of two adjacent blocks (FIGS. 20 & 21) in the first course, with face wall outer surface 23 for each block in the second course being positioned behind face wall inner surface 22 for the first course. This process is repeated for a third course relative to the second course, and for each successive course. As a result, the retaining wall will have a set back relative to vertical characterized by set back angle Δ. The minimum set back (the minimum horizontal set back of the top course relative to the bottom course, i.e., when Δ has a minimum value) for a given module is achieved when the outer surface of a module in an upper course is in contact with the inner surface of the modules upon which it rests (FIG. 25); stated differently, the minimum set back for successive courses of modules is a function of the thickness of face wall 16.

Figure 33:
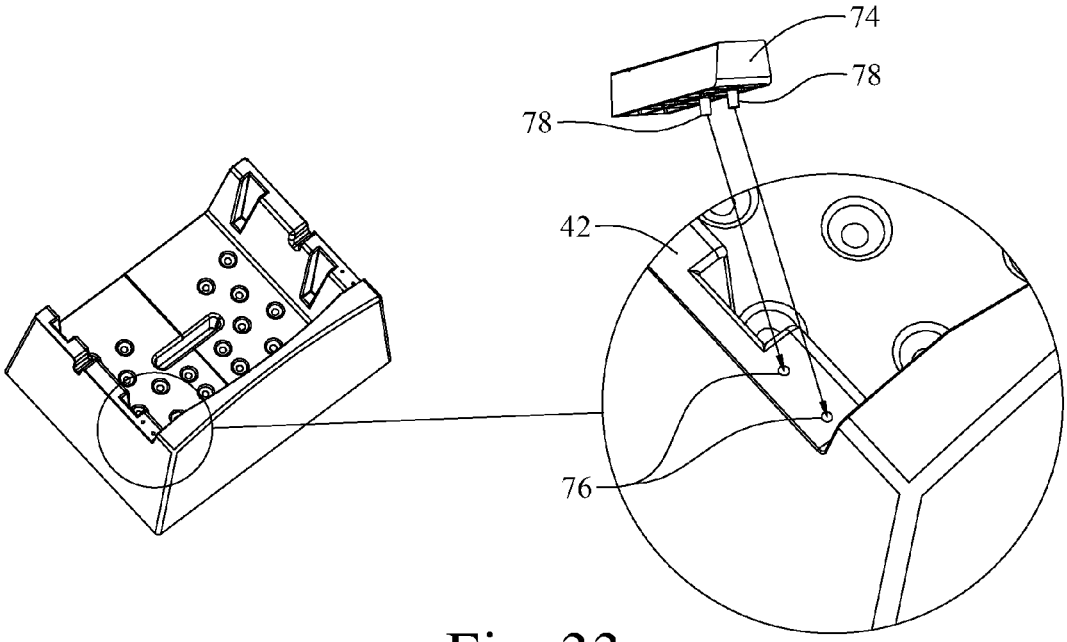
FIG. 33 is a front perspective view of an assembly of a building block of FIG. 1 with a spacer of the present invention (with a detailed view of the side wall)
Figure 34:
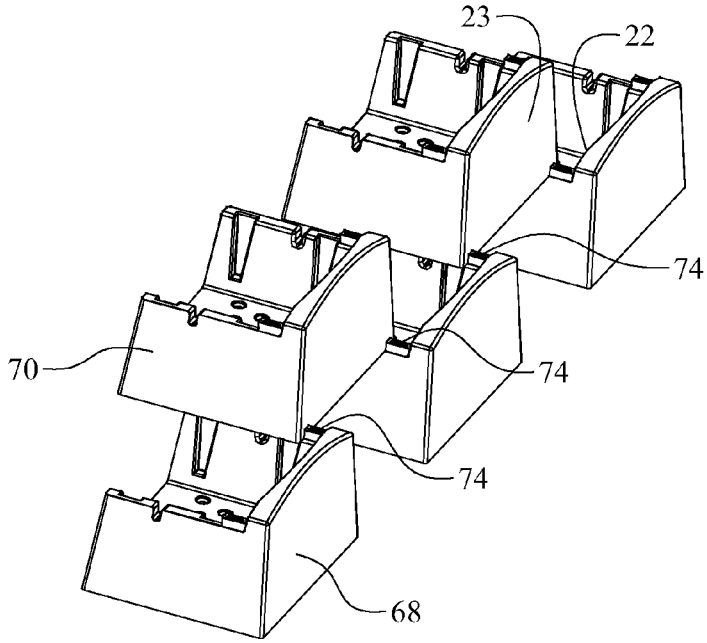
FIG. 34 is a front perspective view of a retaining wall constructed with the assembly of FIG. 33 but with fill material omitted to show detail.

Referring now to FIGS. 33-34, to increase the set back (or increase the value of Δ) uniformly from block-to-block and course-to-course, spacers 74 may be placed between the outer surface 23 of upper course 70 and inner surface 22 of lower course 68. When spacers are used, therefore, the set back is a function of the sum of the thickness of the face wall and the length of spacer 74 (FIG. 33). In one embodiment the thickness of the face wall is such that a retaining wall constructed without the use of spacers will have a Δ with a value of 70° and, when constructed with the use of spacers, will have a Δ with a value of 65°, 60°, 55°, or even 50°. Spacers may be formed from a wide range of materials including, for example, an injection moldable plastic such as polyethylene.

To accommodate spacers 33, side wall tops 42 include apertures 76 proximate face wall inner surface 22 to receive mating spacer posts 78 (FIG. 33). As illustrated, each of the side walls provides two apertures per spacer, but a lesser or greater number of apertures may be provided. Similarly, as illustrated there are two spacer posts per spacer, but a lesser or greater number may be provided so long as there is at least an equal number of apertures.

In an alternative embodiment, side wall tops 42 may have setback markings in addition to or instead of apertures 76 for facilitating placement of blocks in a sloping arrangement on predetermined set back angles. For example, a marking may be made that would facilitate construction of a wall of 70 degree slope, wherein the next higher course of blocks would be stacked so that the bottom forward edge of the front wall of the higher block would rest along the line or other marking associated with the "70." Similarly, to construct a wall of 60 degree slope, the next higher course of blocks would be stacked so that the bottom forward edge of the front wall of the higher block would rest along the line or other marking associated with the "60."

In an alternative embodiment, pins may be employed instead of spacers. That is, vertical pins which are longer than the depth of the apertures may be inserted into the apertures. The apertures may be located in approximately the same positions as the setback markings for predetermined setback angles described above. Thus, to construct a wall of 70 degree slope, a pin may be inserted in each of the holes associated with the "70" on both side walls. Because the pins extend above the upper surface of the side walls, the next higher course of blocks can be stacked so that the bottom forward edge of the front wall of the higher block rests against the installed pin. Similarly, to construct a wall of 60 degree slope, the next higher course of blocks would be stacked so that the bottom forward edge of the front wall of the higher block [44] would rest against the installed pin associated with the "60" on the two underlying blocks.

Referring again to FIG. 2, base inner surface 18 may optionally contain dimples 80 or other shaped recesses or depressions in the bottom receiving trough of the composite block 10 to retain moisture and thus promote vegetation survival and growth during drought conditions. When building block 10 is a composite of at least two different materials, depressions 80 may be pre-formed in liner 26. Alternatively, depressions may be formed in a body 24 of cementitious material, preferably a hydraulic cementitious material using a mold.

In one embodiment, base 12, face wall 14 and side walls 16 comprise a body 24 of non-polymeric cementitious material (and optionally, a liner 26) and are relatively thin as compared, for example, to typical commercially available concrete building blocks. One measure of this is to compare, on a relative basis, the building block volume (that is, the volume collectively occupied by the polymeric and cementitious component parts of building block 10) to the fill receiving cavity volume (that is, the volume of fill receiving cavity 17). The building block volume may be calculated, for example, by determining the volume occupied by each of the component parts (e.g., the volume occupied by base 12, face wall 14, side walls 16 and back wall (if present)) and combining these sums to determine the total volume. Alternatively and more simply, the building block volume may be determined by immersing the building block into a known quantity of water and determining the volume of water displaced by the immersion. Regardless of the methodology, the ratio of the fill receiving cavity volume (actual volume, if determinable, or imaginary cuboid volume as previously described) to the building block volume for building blocks comprising a body of non-polymeric cementitious material may be relatively large, e.g., at least 0.7. In one embodiment, the ratio of the fill receiving cavity volume to the building block volume for building blocks comprising a body of non-polymeric cementitious material is at least 0.8:1, respectively. In one embodiment, the ratio of the fill receiving cavity volume to the building block volume for building blocks comprising a body of non-polymeric cementitious material is at least 0.9:1, respectively. In one embodiment, the ratio of the fill receiving cavity volume to the building block volume for building blocks comprising a body of non-polymeric cementitious material is at least 1:1. In one embodiment, the ratio of the fill receiving cavity volume to the building block volume for building blocks comprising a body of non-polymeric cementitious material is at least 1.1:1. In one embodiment, the ratio of the fill receiving cavity volume to the building block volume for building blocks comprising a body of non-polymeric cementitious material is at least 1.2:1. In one embodiment, the ratio of the fill receiving cavity 17 volume to the building block volume for building blocks comprising a body of non-polymeric cementitious material is between 0.8:1 and 1.5:1, respectively. In one embodiment, the ratio of the fill receiving cavity volume to the building block volume for building blocks comprising a body of non-polymeric cementitious material is between 0.9:1 and 1.4:1, respectively. In one embodiment, the ratio of the fill receiving cavity volume to the building block volume for building blocks comprising a body of non-polymeric cementitious material is between 1:1 and 1.3:1. In one embodiment, the ratio of the fill receiving cavity volume to the building block volume for building blocks comprising a body of non-polymeric cementitious material is about 1.25:1, respectively.

The body 24 of cementitious material may comprise a hydraulic or a non-hydraulic cement. In one embodiment, it is preferably a hydraulic cement and may comprise any known hydraulic cement, including hydraulic cements composed of calcium, aluminum, silicon, oxygen, and/or sulfur which set and harden by reaction with water. Exemplary hydraulic cements include Portland cements, pozzolana cements, gypsum cements, high alumina content cements, silica cements, slag cements high alkalinity cements, and combinations thereof. In certain embodiments, the hydraulic cement may be a Portland cement. In some embodiments, the hydraulic cement may be Portland cement classified as a Class A, C, H, or G cement according to American Petroleum Institute, API Specification for Materials and Testing for Well Cements, API Specification 10, Fifth Ed., Jul. 1, 1990. In some embodiments, the cementitious material may comprise Portland cement or other hydraulic cement and slag, the combination sometimes referred to as slagment. In some embodiments, the cementitious material may also have minor amounts of extenders such as bentonite, gilsonite, with or without any appreciable sand or aggregate material or admixed with a granular filling material such as sand, ground limestone, the like. Strength enhancers such as silica powder or silica flour can be employed as well.

When present, liner 26 comprises a non-cementitious material and is adhered to body 24 and preferably covers at least a fraction of the surface area of base inner surface 18, side wall inner surfaces 20 and face wall inner surface 22 defining fill receiving cavity 17. In a preferred embodiment, liner 26 preferably lines a majority of the surface area of base inner surface 18, side wall inner surfaces 20 and face wall inner surface 22. In one preferred embodiment, liner 26 lines at least 75% of the surface area of base inner surface 18, side wall inner surfaces 20 and face wall inner surface 22. In one preferred embodiment, liner 26 lines at least 90% of the surface area of base inner surface 18, side wall inner surfaces 20 and face wall inner surface 22. In addition, it is generally preferred that liner 26 cover at least a fraction of side wall tops 42. In one embodiment, liner 26 covers at least a majority of the surface area of side wall tops 42. In one preferred embodiment, liner 26 covers at least 90% of the surface area of side wall tops 42. In general, the liner may comprise a synthetic polymeric material such as injection moldable polypropylene, polyethylene or other synthetic polymers, a cellulosic material such as paper, cardboard, or textiles made from plant fibers or even metal. In one embodiment, liner 26 is a synthetic polymer and has a thickness of about 0.1 mm to about 5 mm; more typically liner will be about 0.5 mm to about 2 mm. In one embodiment, liner 26 is about 1.4 to about 1.6 mm.

Depending upon the materials of construction, building blocks 20 may be manufactured in a variety of manners. For example, when building block 20 consists of injection moldable plastic, it may be formed by conventional injection molding techniques (see, e.g., U.S. Pat. No. 5,658,098). When building block 10 comprises a body containing a cementitious material, for example, a hydraulic cement, the body is preferably formed by pouring or otherwise introducing a fluid cementitious material into a mold and, after the cementitious material has partially or substantially cured, removing the (partially) cured body from the mold.

Referring now to FIGS. 10-18, a composite building block comprising a body of cementitious material and a liner of non-cementitious material may be prepared using a two-part mold. The two part mold utilizes an insert 26 (FIGS. 10-13) which becomes the liner of the composite block. The insert (liner) is preferably of polymer material, and preferably formed by injection molding for dimensional precision. In one embodiment, the insert 26 comprises elongate groove 30, channels 40, grooves 54, dimples 80, as previously described, and projections 90 (FIGS. 10-13). In another embodiment, the insert 26 comprises elongate groove 30 but not channels, grooves, dimples, or projections 90. In another embodiment, the insert 26 comprises elongate groove 30 and projections 90, but not channels, grooves, or dimples. In another embodiment, the insert 26 comprises elongate groove 30, projections 90, and channels 40, but not grooves or dimples. In another embodiment, the insert 26 comprises elongate groove 30, projections 90, channels 40, and grooves 54, but not dimples.

Figure 38:
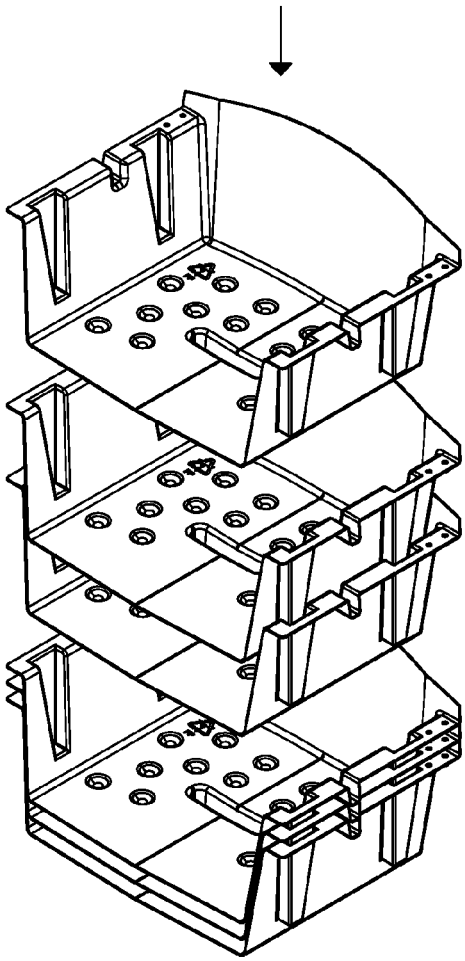
FIG. 38 is a front perspective view of a nested set of the liners/inserts of FIG. 10.

As can be appreciated from FIG. 38, the inserts are able to be stacked in a nested configuration, thus minimizing required storage and shipping volume. While in the nested configuration, various offset features in the upper and lower peripheries of the insert, such as the elongate groove, the dimples and the projections prevent adjacent inserts from wedging together during shipment, the maintaining the dimensional stability of the stack of inserts.

Figure 39:
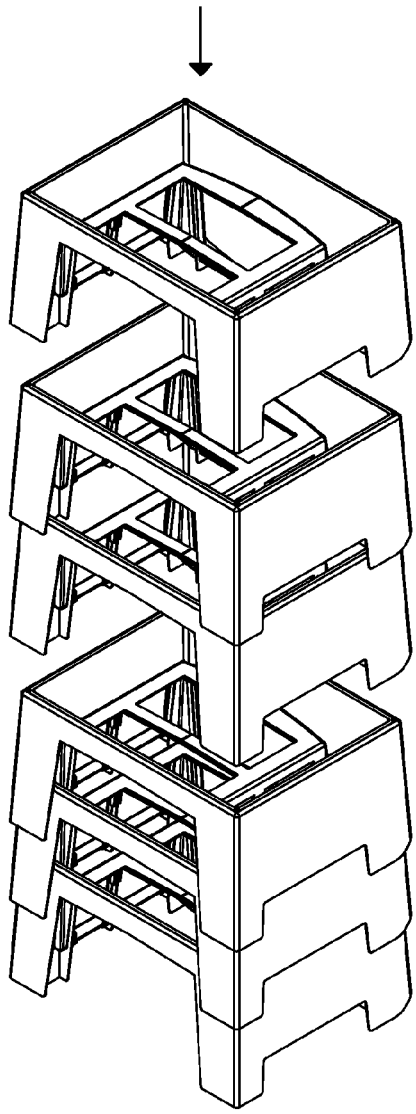
FIG. 39 is a front perspective view of a nested set of mold bases of the present invention.

The insert 26 mates with the mold base 82 (FIG. 14) using a uniform press fit on all four sides to form mold 84 (FIG. 15) which is used to cast the cementitious (concrete in one embodiment) body. Mold base 82 comprises solid exterior walls 85 and support structure 87 (for supporting insert 26). In a preferred embodiment, support structure 87 has openings 89 therein for the passage of air through the support structure from the underside of the mold to aid in the de-molding process. Like insert 26, mold base 82 is able to be stacked in a nested configuration (FIG. 39).

The mold base 82 is configured for weight minimization of the composite block 10 and for minimal internal surface are to facilitate de-molding of the composite block 10 after curing. The drop-in insert 26 covers the areas of poured cement (concrete in one embodiment) which would pose the most difficulty in the de-mold process and then becomes part of the finished block 10. The mold base 82 is configured to be rolled over 180 degrees and then lifted off the finished composite block 10. The front edge of the mold base 88 is configured with rounded and reinforced front edges 89 to facilitate this operation. Because the front edge of the block 10 includes front face 14 of cement body 24 when the cement is poured into the mold, whereas there is no rear face of the block 10, the center of gravity of a filled mold is close to the front edge 88 with its rounded corners. Thus, minimum force is required to roll the mold base 82 to its inverted position. In addition, it is preferred that the four corners of the top of the solid exterior walls have a raised surface such that, when the mold is rolled over, the outer surface 19 of the base does not contact the floor and the rolling-over of the mold imparts a jarring force that aids in the dislodging of the block 10 from the mold base.

The mold base and/or insert may be opaque, translucent or even clear. Preferably, the mold base is sufficiently translucent (or even transparent) to permit inspection of cement introduced to the mold while it remains in a fluid state. Advantageously, translucent molds permit the opportunity to visually confirm by viewing from the outside of and through the mold, that the mold has been filled to the desired extent and that no there are no air gaps or clumps of aggregate that prevent flow of cement into parts of the mold. For example, air bubbles or clumps of aggregate that may sometimes form when cement is introduced to the mold may be seen from outside the mold and mechanically dislodged.

Figure 14:
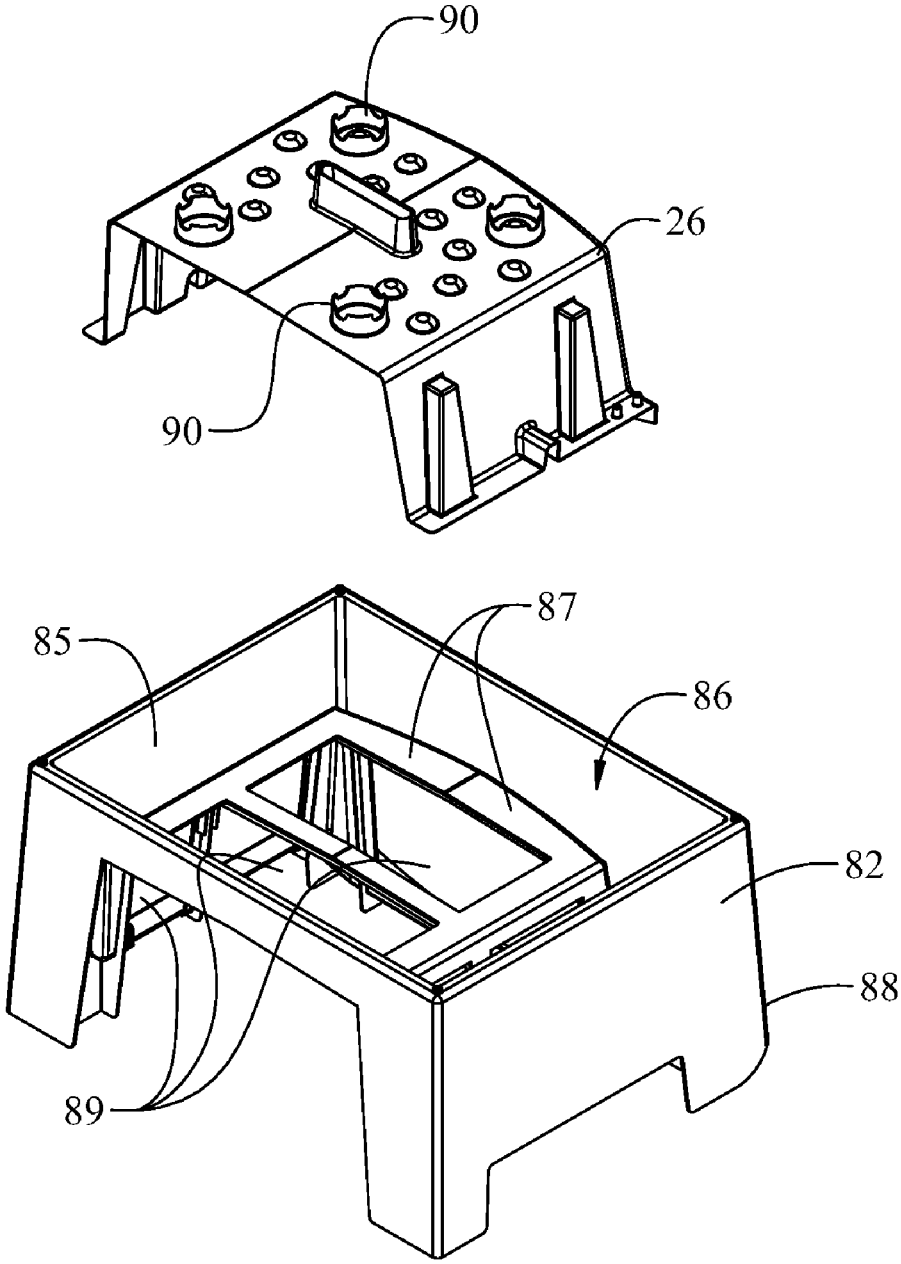
FIG. 14 is an exploded view of the two-part mold of the present invention.

FIG. 14 is a front view of the mold base 82 with insert 26 being lowered into mold cavity 86 prior to filling with wet cement (concrete in one embodiment). When combined, insert 26 is supported by, but not bonded to, support surface 87. Cement is poured into mold cavity 86 onto insert (liner) underside 92 and allowed to cure. Advantageously, the press-fit between the insert and the mold base is enhanced by the downward force exerted by the cementitious material poured onto or otherwise introduced into mold cavity 86 to provide a leak-free seal between the two mold parts.

Figure 16:
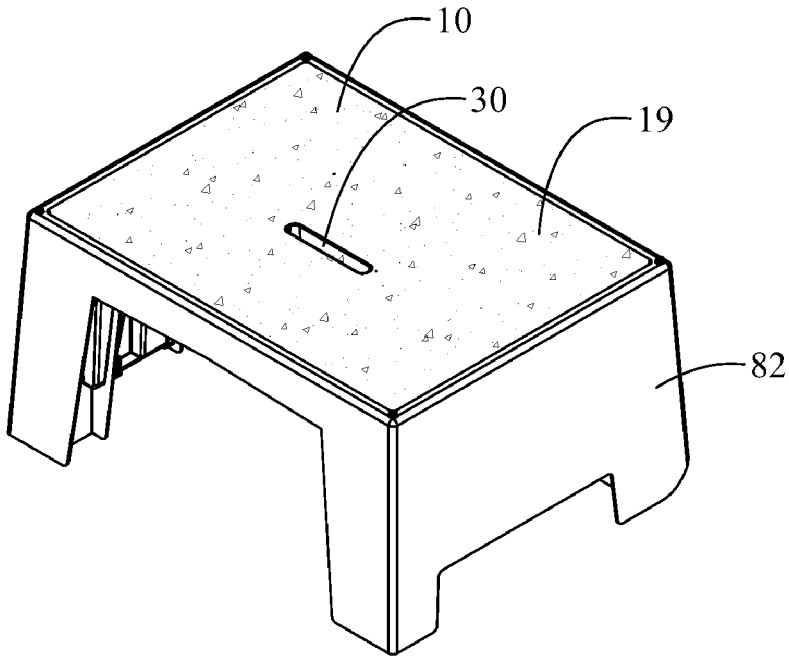
FIG. 16 is a front perspective view of the assembled two-part mold of FIG. 15 filled with a cementitious material.
Figure 17:
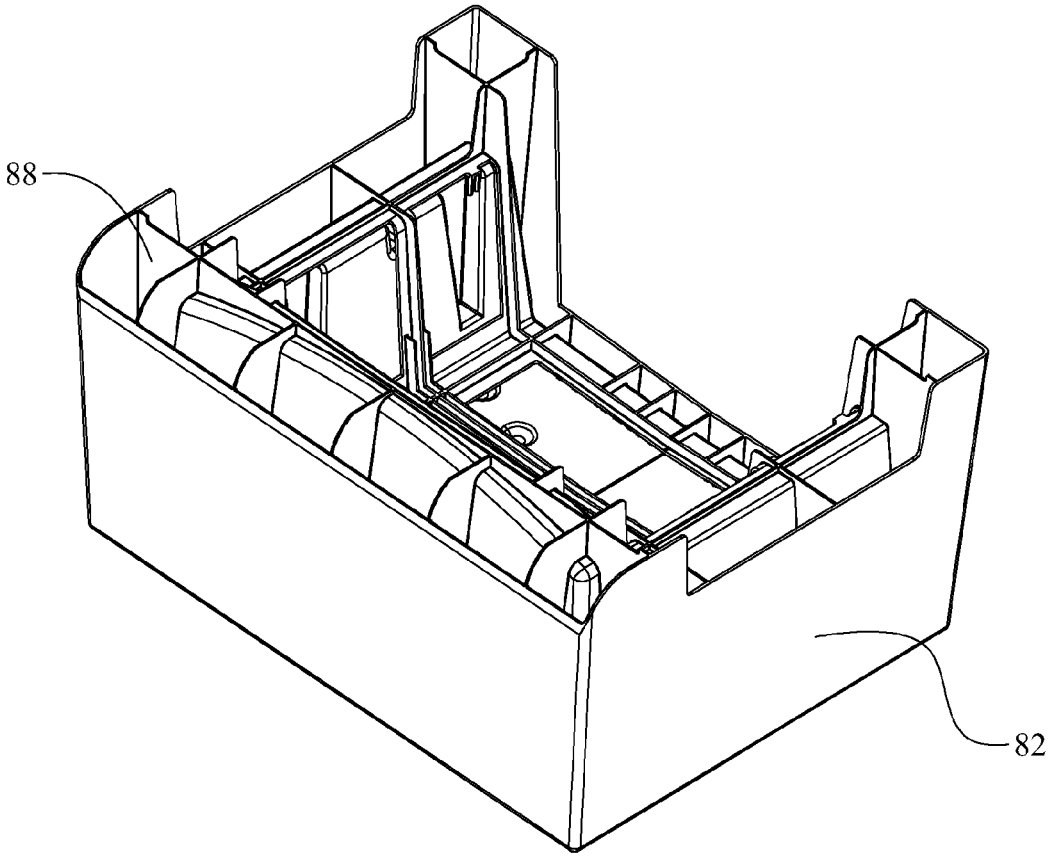
FIG. 17 is a rear perspective view of the filled mold of FIG. 16 in an inverted position.
Figure 18:
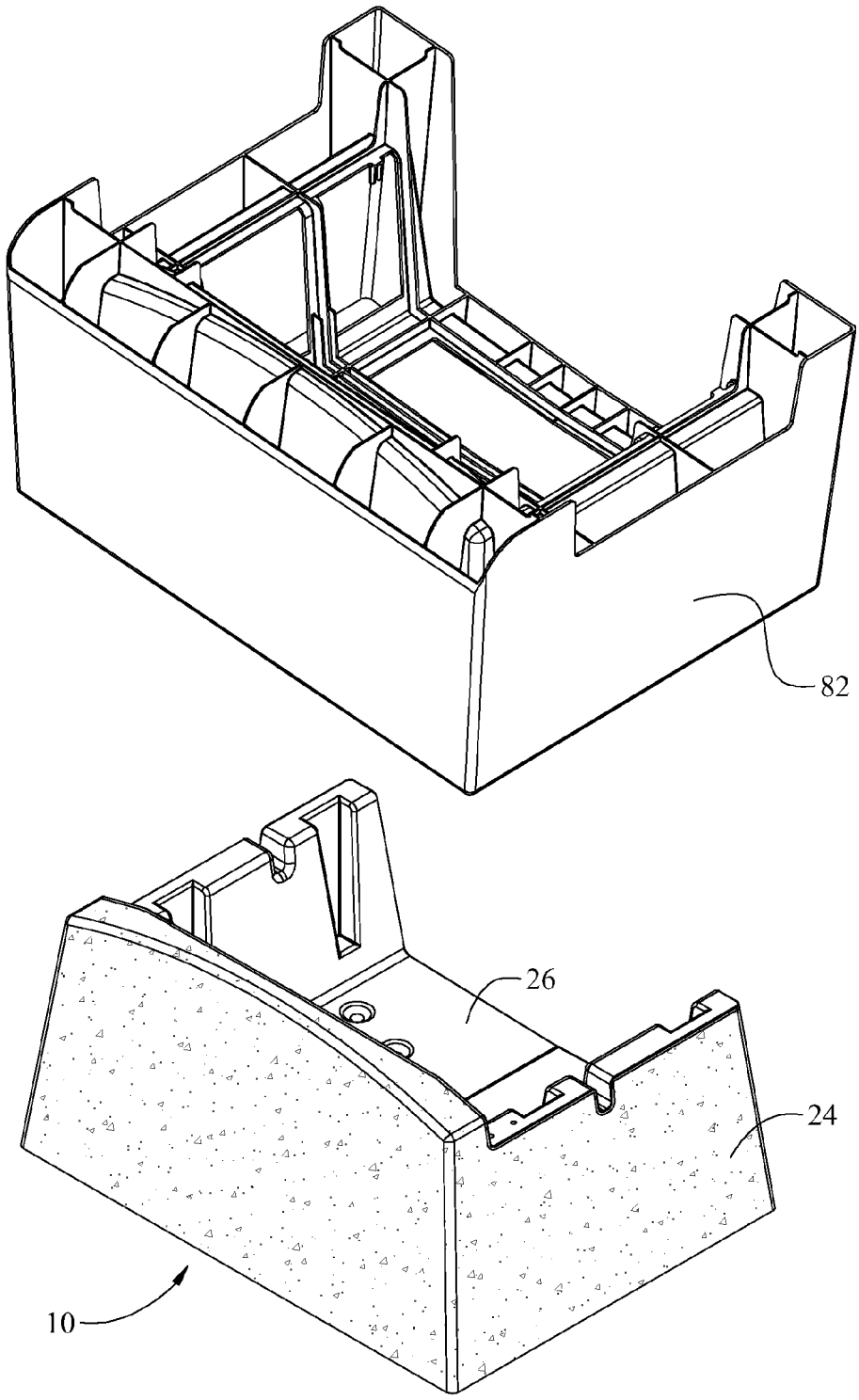
FIG. 18 is a rear perspective view of the building block of FIG. 1 removed from the filled mold of FIG. 17.

FIG. 16 is a top view of the insert installed in the mold base and properly filled with wet cement (concrete in one embodiment). The formed wet cement (concrete in one embodiment) body 24 becomes bonded to insert 26 to form the composite polymer/cement (concrete in one embodiment) block 10. The cement filled mold 94 is then rolled into an inverted position (FIG. 17) to facilitate demolding (FIG. 18). When demolded, the insert 26 remains with the cement body to form the liner. Advantageously, because the insert is merely supported by and not bonded to support structure 87, there is less bonding between the cement body and mold base, thereby aiding in the demolding process.

Figure 10:
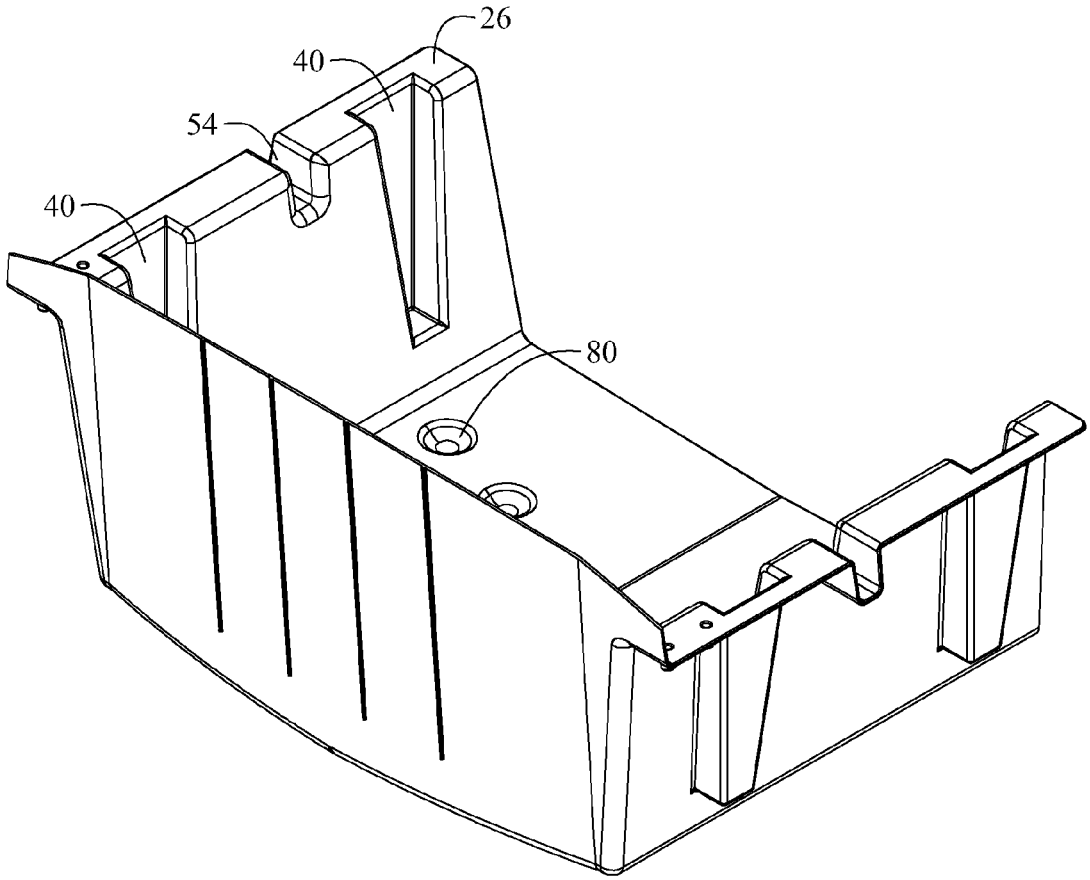
FIG. 10 is front perspective of a liner/insert of the present invention.
Figure 11:
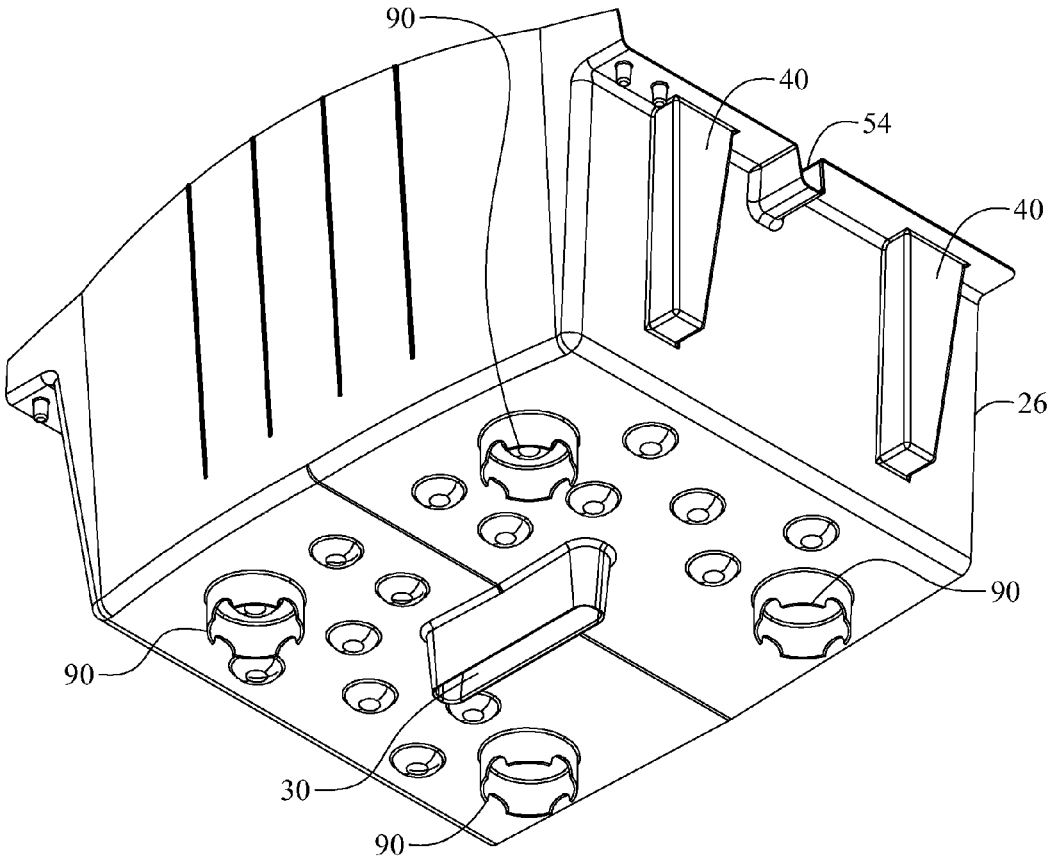
FIG. 11 is a bottom perspective of the liner/insert of FIG. 10.
Figure 12:
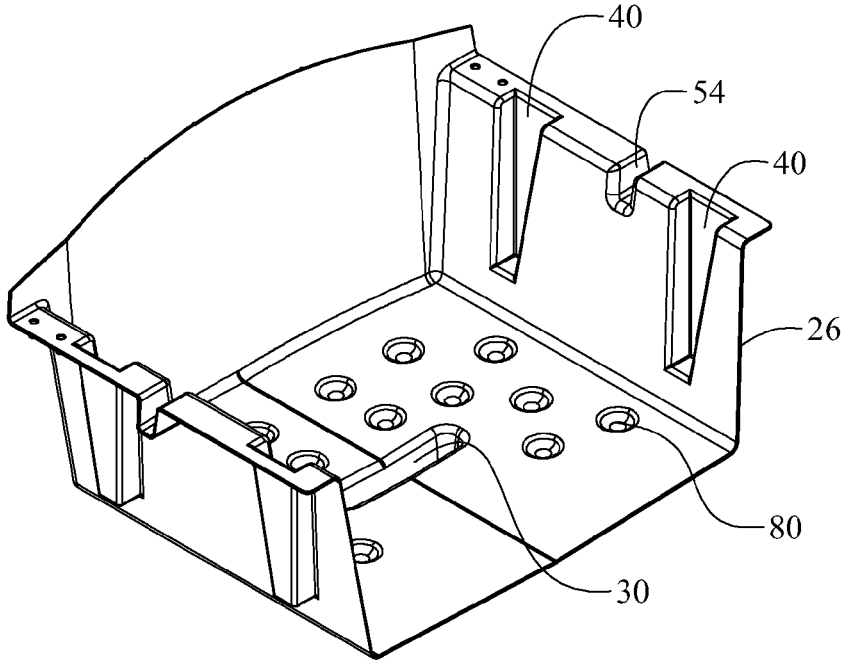
FIG. 12 is a rear perspective view of the liner/insert of FIG. 10.

As shown in FIG. 10, the insert/liner 26 also preferably comprises channels 40 on both side walls to receive a drop-in structural support bracket (FIGS. 30-32) which adds stability to the constructed block wall system in tight radii curved walls. These channels 40 also may receive a lifting bracket to facilitate connection with lifting machinery, such as hoists, cranes and forklifts to facilitate handling of blocks for palletizing in the factory and for lifting and setting the composite blocks into a wall during field construction. As shown in FIGS. 10 and 12, the lower surface of the insert 29 may also be formed with concave dimples 80 or other shaped recesses in the bottom receiving trough of the composite block 10 to retain moisture and thus promote vegetation survival and growth during drought conditions.

Figure 13:
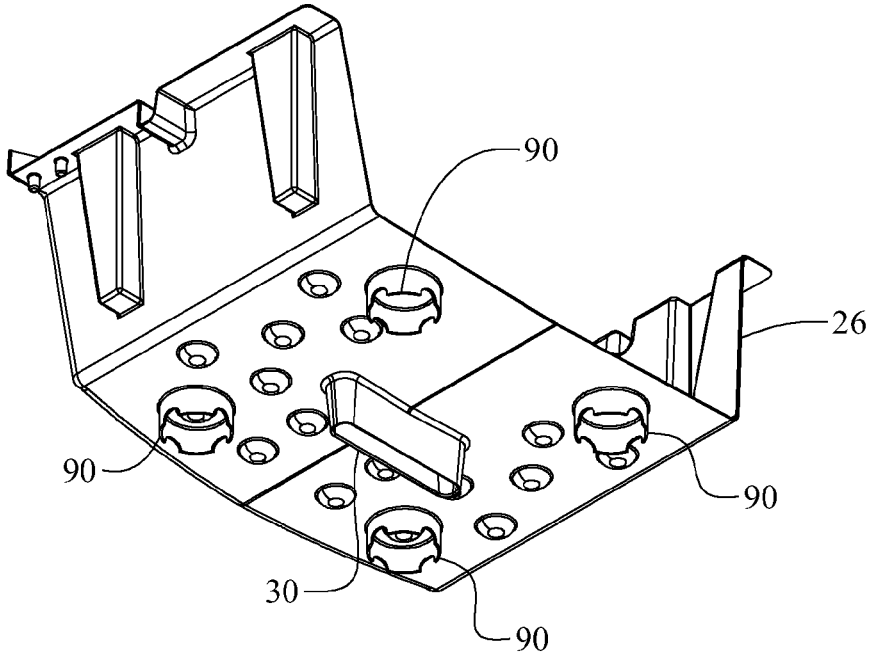
FIG. 13 is a bottom perspective view of the liner/insert of FIG. 10.
Figure 15:
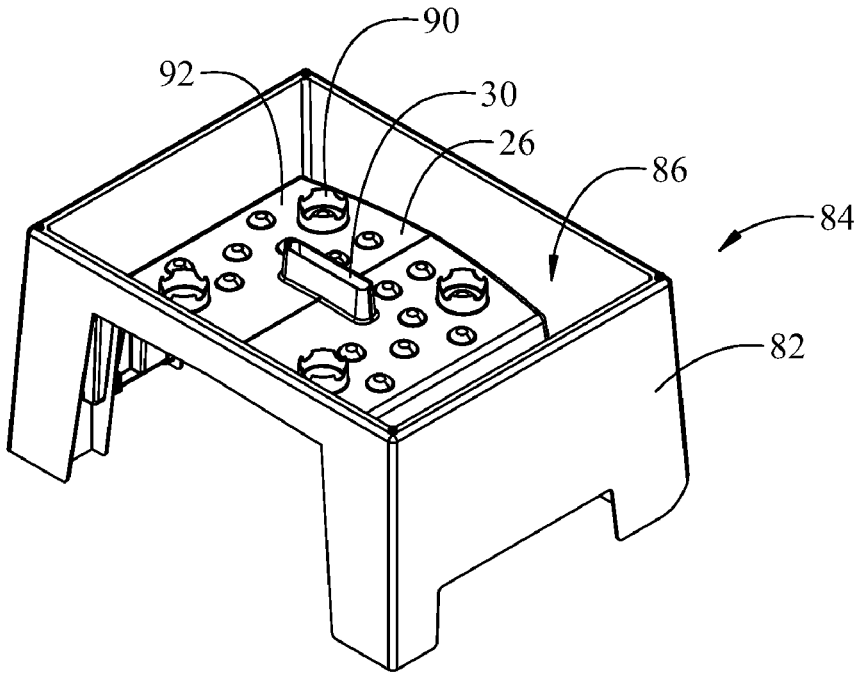
FIG. 15 is a front perspective view of the two-part mold of FIG. 14 in assembled form.
Figure 35:
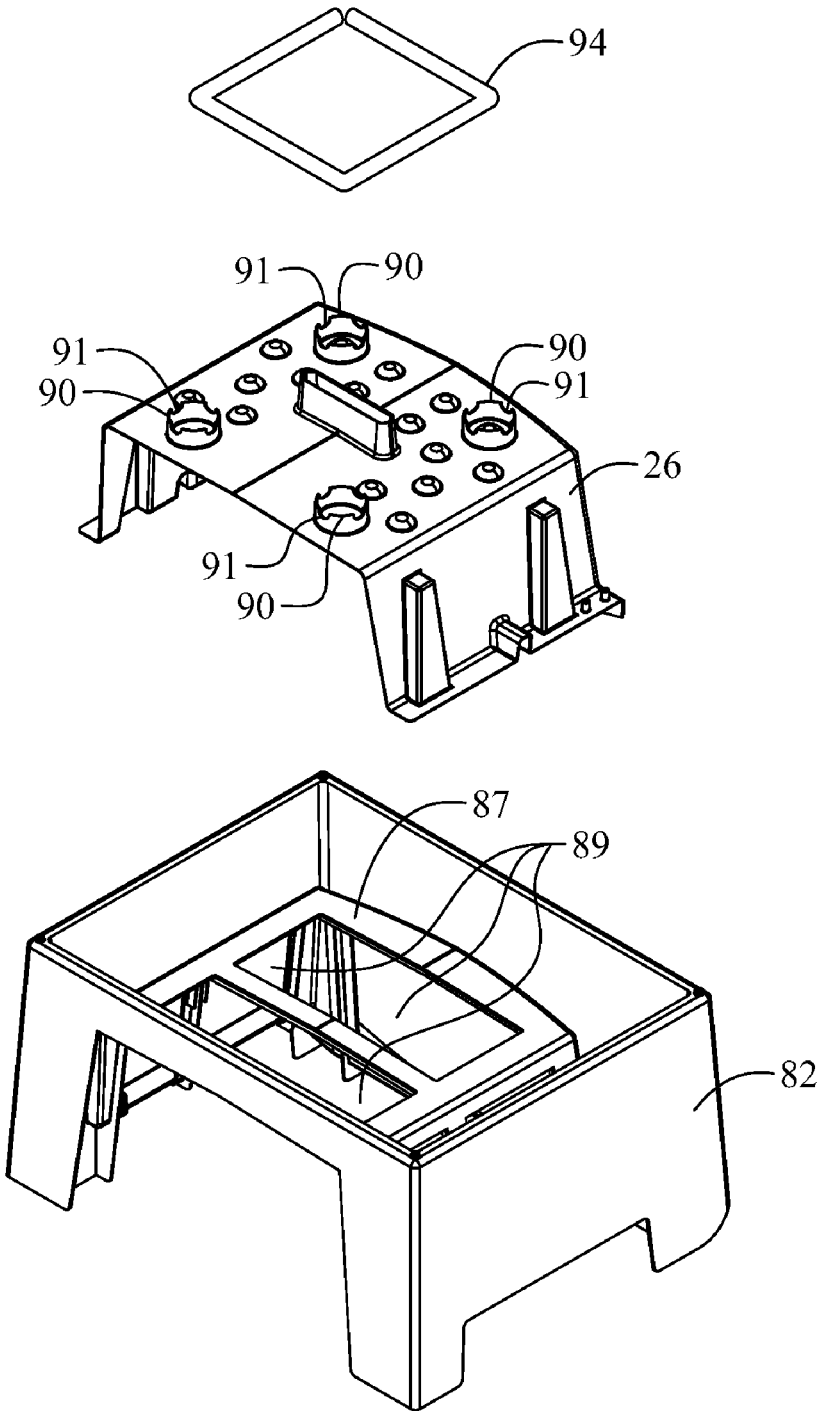
FIG. 35 is an exploded front perspective view of the two-part mold of the present invention with a reinforcement bar.
Figure 36:
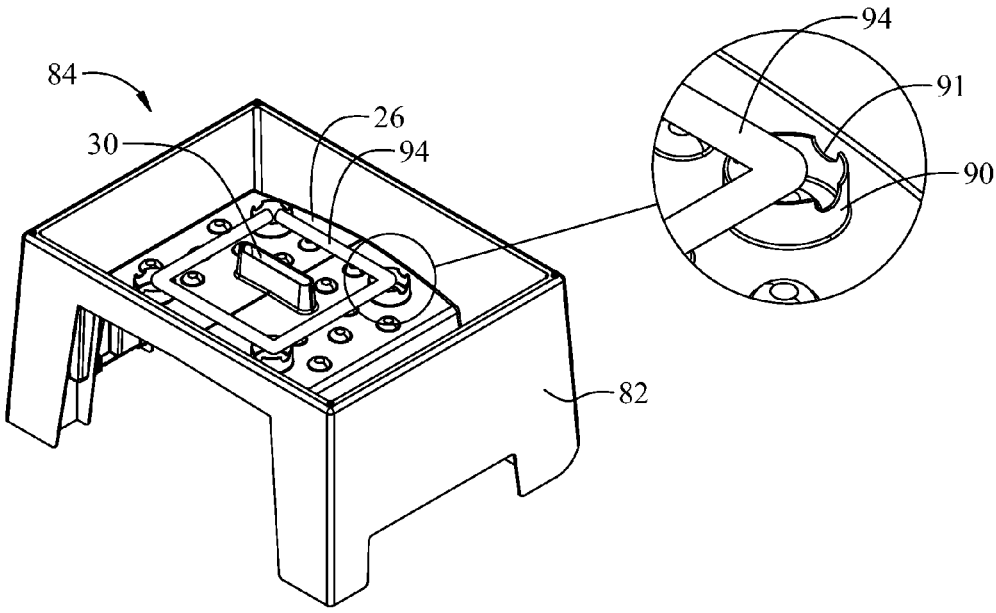
FIG. 36 is a front perspective of the two-part mold and a reinforcement bar of FIG. 35 in assembled form.
Figure 37:
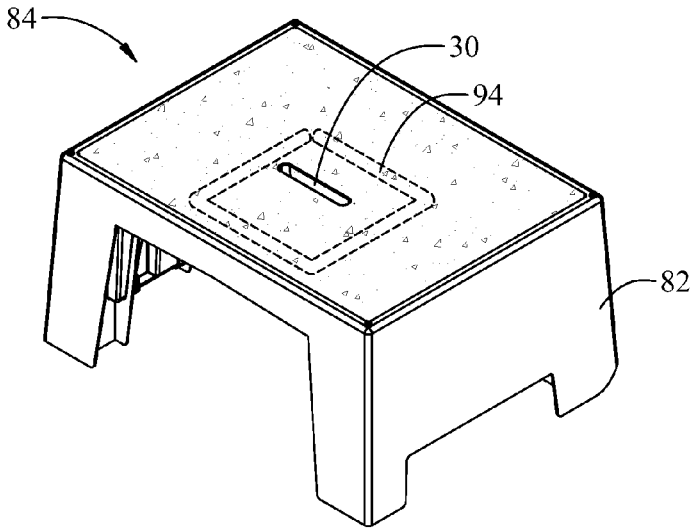
FIG. 37 is a front perspective view of the assembled two-part mold of FIG. 36 showing the reinforcement bar in phantom.

As shown in FIG. 13, projections 90 on the underside of the insert 26 are provided to increase the contact area and bond between the insert (liner) 26 and the cement body 24. The projections 90 will be oriented in the upward direction when the insert and mold are mated and in position to receive wet cement (FIGS. 14-15). In addition, projections 90 preferably have cut-out support surfaces 91 configured to facilitate placement of steel reinforcement bar members 94 into the building blocks during casting, if desired (FIGS. 35-37). As illustrated, the reinforcing bar is a bent loop of steel reinforcing bar, but it should be understood that materials other than steel may be used as a reinforcing material and that the reinforcing material may have different geometric shape or size. For example, a single linear bar may be supported by the cut-outs of two projections. Regardless of material of material of construction or the shape of the reinforcing material, the reinforcing material is supported by projections to embed the reinforcing material in the body of cement material.

In general, for molding purposes the cement poured into the mold contains sufficient fluid to form a pourable or pumpable cementitious slurry. The fluid is preferably fresh or salt water, i.e., an unsaturated aqueous salt solution or a saturated aqueous salt solution such as brine or seawater. The amount of water present may vary and is preferably selected to provide a hydraulic cement slurry having a desired density. The amount of water in the slurry is typically in a range of that which is conventionally used to prepare cements including, for example, what is commonly known as wet-cast or dry-cast cement or concrete.

After the cement is poured or otherwise introduced to the mold, it is allowed to cure for a period of time in the mold (FIG. 16). In one embodiment, it is allowed to cure in the mold for at least 2 hours. More typically, it is allowed to cure for at least 4 hours. In one preferred embodiment, the cement is allowed to cure for at least 8 hours before the filled mold is inverted, i.e., rolled-over (FIG. 17) and a composite building block 10 comprising a cement body 24 and liner 26 is removed from the mold base 82 (FIG. 18).

In one alternative embodiment, after composite building block 10 is removed from mold base 82, liner 26 is partially or completely stripped (or otherwise separated from) from cement body 24 to yield a non-composite cement building block having the shape imparted by each part of the two-part mold (i.e., the mold base and the insert). Such non-composite cement building blocks thus may comprise elongate grooves (or other openings extending through the base of the block), channels for receiving support structures, grooves for receiving baffles, and/or dimples for retaining moisture, as described in connection with the composite building block of the present invention.

In an alternative embodiment, a mold is used to cast the cement wherein the mold is filled with cement, the cement is allowed to cure in and bond to the mold to form a composite building block, and the building block is used, as-is, that is, without de-molding the cement body from the mold. In this embodiment, the mold is preferably formed by injection molding and comprises an injection moldable synthetic polymer such as polypropylene or polyethylene (although other synthetic polymers may also be used). In this embodiment, the product is a composite comprising a body of cement having an outer surface lined by a synthetic polymeric material; for example, the inner and outer surfaces of the face wall, the inner and outer surfaces of the side walls and the inner surface of the base may have an exposed polymeric material with a body of cement underlying the exposed polymeric surface. If desired, all or part of the exposed polymeric liner may be stripped from the body of cement, for example, from the face wall outer surface and/or the side wall outer surfaces.

Another embodiment of the present invention comprises an insert as previously described, with the addition of a face wall insert, which is preferably slidably inserted in the mold base such that it interfaces with the cement (concrete in one embodiment) which ultimately forms the face wall outer surface 23. Thus, during the demold process, the face wall outer surface 23 remains in contact with the face wall insert, which slides out of the mold base 82. This results in a reduction of the total surface area of the block which must be disengaged from interfacing with the mold base surfaces, simplifying the demold process. Once the block and face wall insert are removed from the mold base 82, the face wall insert may be removed from the block to produce a block 10 with a face wall outer surface having a contour corresponding to the contour of the face wall insert. Thus, a block having textured face wall surface may be produced using a face wall insert which has a textured interior surface which interfaces with the wet cement (concrete in one embodiment) poured into the mold. Similarly, using a face wall insert which has an interior surface comprising symbols, test, patterns, designs and shapes, like configurations of the face wall of the block may be achieved.

Alternatively, the interior surface of the face wall insert may secure the face wall insert to the exterior of the face wall of the block. Thus, a face wall may be produced having an exterior surface comprising symbols, text, patters, designs and shapes embodied in the premanufactured face wall insert. Further, the face wall insert may be formed of various materials, including polymers, metal, rock, wood, glass, or ceramics for a wide range of functional and/or aesthetic purposes. For example, in the case of a face wall insert made of aluminum or steel, various metal structures may be welded to the face wall insert [88]. Additionally, the face wall inserts of adjoining blocks may be joined using welding or other processes to enhance the structural integrity of the wall, or to facilitate the attachment of structures, such as lighting or plumbing fixtures, or ornamental structures or containers. Thus, a block having a multitude of potential attached structures to accomplish a wide variety of purposes may be achieved.

In an alternative embodiment, building block 10 is of a suitable polymeric material, such as an injection moldable polyethylene, preferably having a density of less than approximately 65 lbs/ft$^3$, and more preferably having a density of less than approximately 50 lbs/ft$^3$, and most preferably having a density of less than approximately 40 lbs/ft$^3$. In one embodiment, the polymeric building block comprises channels on both side walls to receive a drop-in structural support bracket (as described in connection with the composite building block) which adds stability to the constructed block wall system in tight radii curved walls. In another embodiment, the polymeric building block additionally or alternatively comprises grooves on either or both side walls to receive a baffle (as described in connection with the composite building block). In another embodiment, the polymeric building block additionally or alternatively comprises an elongate slot or other opening in the bottom for attachment of retaining means (as described in connection with the composite building block). In another embodiment, the polymeric building block additionally or alternatively comprises concave dimples or other shaped recesses in the bottom receiving trough of the block to retain moisture and thus promote vegetation survival and growth during drought conditions (as described in connection with the composite building block).

Figure 19:
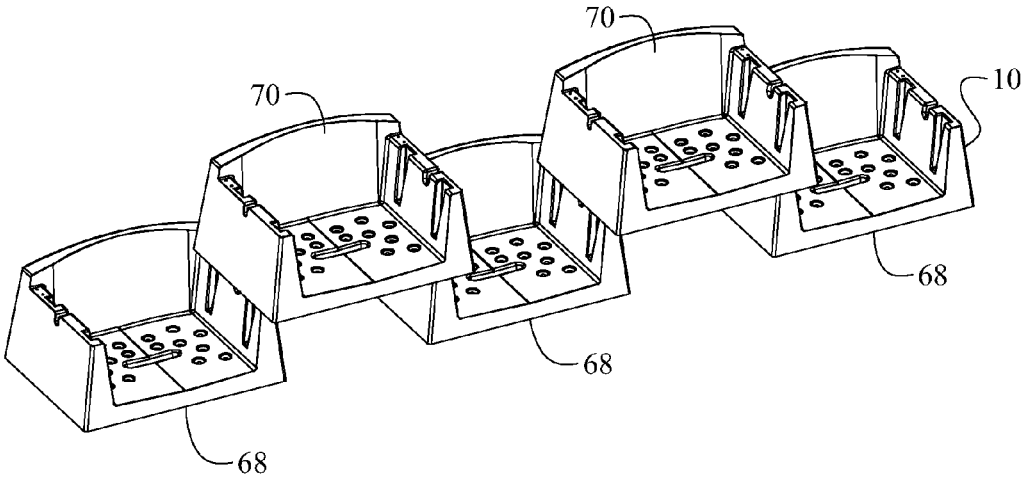
FIG. 19 is a rear perspective view of a retaining wall constructed of building blocks of FIG. 1 but with fill material omitted to show detail.
Figure 20:
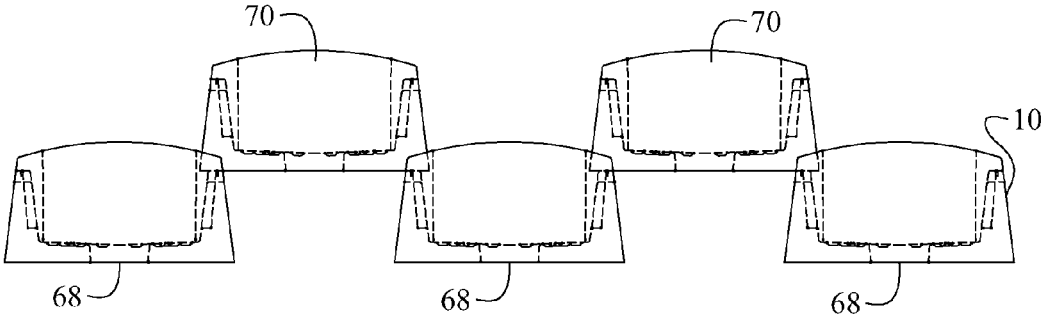
FIG. 20 is a rear elevation view of the retaining wall of FIG. 19.

Referring now to FIGS. 19, 20, 23, 24, 25 and 34, retaining walls constructed of building blocks of the present invention are illustrated. FIGS. 19 and 20 show rear views of a retaining wall constructed of building blocks of the present invention; to show detail, the retaining wall is shown without fill material. Also, although the retaining wall is shown with only two courses of blocks, it is to be understood that retaining walls with more or fewer courses could be constructed with the building blocks of the present invention. FIGS. 23 and 24 show top views of a retaining wall constructed with building blocks of the present invention comprising a reinforcing material 32 having at least one end 38 anchoring the building block 10 to the mass of earth or fill material behind the wall (not shown); FIG. 23 shows this for a convex wall and FIG. 24 shows this for a concave wall.

In one preferred embodiment, a handle or other lifting bracket is inserted into the elongate slot 30 to manipulate the filled mold (FIG. 16) or building block 10 (FIG. 2) during transportation or construction of a retaining wall.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

Having described the invention in detail, it will be apparent that modifications and variations are possible without departing the scope of the invention defined in the appended claims.

What is claimed is:

1. A retaining wall building block for receiving fill material during construction of a retaining wall, the block comprising:

a cast cement body having a base, a generally upright face wall extending upward from the base, two generally upright side walls extending upward from the base and generally rearward of the face wall, the base, face and side walls having inner and outer surfaces, the face wall extending above the two side walls, the base of the building block comprising an elongate slot; and a polymeric liner proximate to the cement body which lines the inner surfaces of the base, face and side walls of the block.

2. The retaining wall building block of claim 1 wherein the side walls of the building block comprise a set of channels adapted to receive a support bracket that extends from one side wall to the other side wall for supporting an upper course of building blocks when the building blocks are assembled to form a retaining wall.

3. The retaining wall building block of claim 1 wherein the side walls of the building block comprise at least one groove that extends from the inner surface to the outer surface of the side wall(s) adapted to receive a shield comprising a baffle and a tongue wherein the tongue is sized to be inserted in and retained by the groove to position the baffle beyond the outer surface of the side wall and in an orientation that is generally parallel to the face wall.

4. The retaining wall building block of claim 1 wherein the polymeric liner lines the elongate slot.

5. The retaining wall building block of claim 1 wherein the polymeric liner lines the elongate slot, the elongate slot has a length $L_s$ as measured in a direction parallel to the face wall and a width $W_s$ as measured in a direction perpendicular to the face wall and the ratio of $L_s$ to $W_s$ is at least 5:1, respectively.

6. The retaining wall building block of claim 1 wherein the elongate slot has a length $L_s$ as measured in a direction parallel to the face wall and a width $W_s$ as measured in a direction perpendicular to the face wall and the ratio of $L_s$ to $W_s$ is at least 5:1, respectively.

7. The retaining wall building block of claim 1 wherein the base has a rear edge that is distal to the face wall, and the elongate slot is located in the base at a distance, as measured from the rear edge and in the direction of the face wall inner surface, that is at least 20% of the distance between the rear edge and the face wall inner surface.

8. The retaining wall building block of claim 1 wherein the base has a rear edge that is distal to the face wall, the elongate slot is located in the base at a distance, as measured from the rear edge and in the direction of the face wall inner surface, that is between 25% and 75% of the distance between the rear edge and the face wall inner surface, the elongate slot has a length $L_s$ as measured in a direction parallel to the face wall and a width $W_s$ as measured in a direction perpendicular to the face wall, and the ratio of $L_s$ to $W_s$ is at least 5:1, respectively.

9. The retaining wall building block of claim 8 wherein the polymeric liner lines the elongate slot.

10. The retaining wall building block of claim 1 wherein the base has a rear edge that is distal to the face wall, the two side walls extend generally rearward of the face wall to the rear edge of the base and have a height as measured upward from the base, and the retaining wall building block lacks a rear wall extending upward from the base proximate the rear edge that (i) fully extends between the two side walls, and (ii) has a height as measured upward from the base that is great as the height of the two side walls.

11. The retaining wall building block of claim 10 wherein the polymeric liner lines the elongate slot, the elongate slot has a length $L_s$ as measured in a direction parallel to the face wall and a width $W_s$ as measured in a direction perpendicular to the face wall and the ratio of $L_s$ to $W_s$ is at least 5:1, respectively.

12. The retaining wall building block of claim 10 wherein the elongate slot has a length $L_s$ as measured in a direction parallel to the face wall and a width $W_s$ as measured in a direction perpendicular to the face wall and the ratio of $L_s$ to $W_s$ is at least 5:1, respectively.

13. The retaining wall building block of claim 10 wherein the base has a rear edge that is distal to the face wall, and the elongate slot is located in the base at a distance, as measured from the rear edge and in the direction of the face wall inner surface, that is at least 20% of the distance between the rear edge and the face wall inner surface.

14. The retaining wall building block of claim 10 wherein the base has a rear edge that is distal to the face wall, the elongate slot is located in the base at a distance, as measured from the rear edge and in the direction of the face wall inner surface, that is between 25% and 75% of the distance between the rear edge and the face wall inner surface, the elongate slot has a length $L_s$ as measured in a direction parallel to the face wall and a width $W_s$ as measured in a direction perpendicular to the face wall, and the ratio of $L_s$ to $W_s$ is at least 5:1, respectively.

15. The retaining wall building block of claim 14 wherein the polymeric liner lines the elongate slot.

16. The retaining wall building block of claim 1 wherein the polymeric liner comprises an upper side and an underside, the underside being proximate the inner surface of the side walls and the base, and the polymeric liner comprises projection on its underside that extend into the cast cement body to increase the contact area and bond between the polymeric liner and the cast cement body.

17. The retaining wall building block of claim 16 wherein the base has a rear edge that is distal to the face wall, the two side walls extend generally rearward of the face wall to the rear edge of the base and have a height as measured upward from the base, and the retaining wall building block lacks a rear wall extending upward from the base proximate the rear edge that (i) fully extends between the two side walls, and (ii) has a height as measured upward from the base that is great as the height of the two side walls.

18. The retaining wall building block of claim 17 wherein the polymeric liner lines the elongate slot.

19. The retaining wall building block of claim 17 wherein the polymeric liner lines the elongate slot, the elongate slot has a length $L_s$ as measured in a direction parallel to the face wall and a width $W_s$ as measured in a direction perpendicular to the face wall and the ratio of $L_s$ to $W_s$ is at least 5:1, respectively.

20. The retaining wall building block of claim 17 wherein the elongate slot has a length $L_s$ as measured in a direction parallel to the face wall and a width $W_s$ as measured in a direction perpendicular to the face wall and the ratio of $L_s$ to $W_s$ is at least 5:1, respectively.

21. The retaining wall building block of claim 17 wherein the base has a rear edge that is distal to the face wall, and the elongate slot is located in the base at a distance, as measured from the rear edge and in the direction of the face wall inner surface, that is at least 20% of the distance between the rear edge and the face wall inner surface.

22. The retaining wall building block of claim 17 wherein the base has a rear edge that is distal to the face wall, the elongate slot is located in the base at a distance, as measured from the rear edge and in the direction of the face wall inner surface, that is between 25% and 75% of the distance between the rear edge and the face wall inner surface, the elongate slot has a length $L_s$ as measured in a direction parallel to the face wall and a width $W_s$ as measured in a direction perpendicular to the face wall, and the ratio of $L_s$ to $W_s$ is at least 5:1, respectively.

* * * * *